US012252964B2

(12) United States Patent
Prisbell et al.

(10) Patent No.: US 12,252,964 B2
(45) Date of Patent: Mar. 18, 2025

(54) LARGE SHAPED CHARGE PERFORATION TOOL

(71) Applicant: Schlumberger Technology Corporation, Sugar Land, TX (US)

(72) Inventors: Andrew Prisbell, Sugar Land, TX (US); Erick Lowe, Clamart (FR); Hari Prakash Kalakonda, Pune (IN); Jay Garza, La Marque, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/252,575

(22) PCT Filed: Nov. 15, 2021

(86) PCT No.: PCT/US2021/059401
§ 371 (c)(1),
(2) Date: May 11, 2023

(87) PCT Pub. No.: WO2022/104221
PCT Pub. Date: May 19, 2022

(65) Prior Publication Data

US 2024/0003229 A1 Jan. 4, 2024

Related U.S. Application Data

(60) Provisional application No. 63/198,794, filed on Nov. 13, 2020.

(51) Int. Cl.
*E21B 43/117* (2006.01)
*E21B 43/1185* (2006.01)
*E21B 43/119* (2006.01)

(52) U.S. Cl.
CPC ..... *E21B 43/117* (2013.01); *E21B 43/1185* (2013.01); *E21B 43/119* (2013.01)

(58) Field of Classification Search
CPC ... E21B 43/117; E21B 43/1185; E21B 43/119
See application file for complete search history.

(56) References Cited

U.S. PATENT DOCUMENTS 2,062,974 A 12/1936 Lane
D126,856 S 4/1941 Ricou
(Continued)

FOREIGN PATENT DOCUMENTS

CA 2532088 C 7/2009
CA 3044516 A1 7/2018
(Continued)

OTHER PUBLICATIONS

Advisory Action issued in U.S. Appl. No. 14/888,882 dated Sep. 21, 2021, 6 pages.
(Continued)

*Primary Examiner* — D. Andrews
*Assistant Examiner* — Ronald R Runyan
(74) *Attorney, Agent, or Firm* — Jeffrey D. Frantz

(57) ABSTRACT

A perforation tool features a container with a longitudinal axis; an initiator module in the container, the initiator module having a firing circuit, an electrical contact at the longitudinal axis, and a detonator housing; and a shaped charge frame in the container, the shaped charge frame having a first end; a second end opposite the first end; a recess for accepting a shaped charge between the first end and the second end, the recess having a wide end and a narrow end, wherein the longitudinal axis is between the wide end and the narrow end; a first electrical contact at the first end, the first electrical contact located at the longitudinal axis; a second electrical contact at the second end, the
(Continued)

second electrical contact located at the longitudinal axis; an electrical conductor connecting the first and second contacts; and a ballistic pathway coupling the detonator housing to the narrow end of the recess.

10 Claims, 13 Drawing Sheets

(56) References Cited

U.S. PATENT DOCUMENTS 2,252,270 A 8/1941 Miller
2,980,017 A 4/1961 Castel
3,067,679 A 12/1962 Caldwell et al.
3,173,992 A 3/1965 Boop
3,612,189 A 10/1971 Brooks et al.
3,836,843 A 9/1974 Yonce
3,965,993 A 6/1976 Lavigne et al.
3,991,836 A 11/1976 Bouguyon et al.
4,004,643 A 1/1977 Newman
4,191,265 A 3/1980 Bosse-Platiere
4,296,481 A 10/1981 Weiss
D265,335 S 7/1982 Kirkpatrick
4,519,313 A 5/1985 Leidel
4,523,649 A 6/1985 Stout
4,619,333 A 10/1986 George
4,759,291 A 7/1988 Barker et al.
4,850,438 A 7/1989 Regalbuto
4,909,320 A 3/1990 Hebert et al.
5,007,486 A 4/1991 Ricles
5,237,136 A * 8/1993 Langston ..... H01H 35/24 175/2
5,351,622 A 10/1994 Ekholm
5,756,926 A 5/1998 Bonbrake et al.
5,785,130 A 7/1998 Wesson et al.
5,816,343 A 10/1998 Markel et al.
6,082,265 A 7/2000 Sakamoto et al.
6,311,621 B1 11/2001 Marshall et al.
6,412,338 B2 7/2002 Boyle et al.
6,412,388 B1 7/2002 Frazier
6,412,415 B1 7/2002 Kothari et al.
6,595,290 B2 7/2003 George et al.
6,655,289 B1 12/2003 Bornheim et al.
6,752,083 B1 6/2004 Lerche et al.
7,013,977 B2 3/2006 Nordaas
7,347,278 B2 3/2008 Lerche et al.
7,762,331 B2 7/2010 Goodman et al.
D633,166 S 2/2011 Richardson et al.
D642,235 S 7/2011 Harasts et al.
8,002,035 B2 8/2011 Hales et al.
8,056,632 B2 11/2011 Goodman
8,066,083 B2 11/2011 Hales et al.
8,113,119 B2 2/2012 Crawford
8,127,848 B2 3/2012 Myers, Jr. et al.
8,256,337 B2 9/2012 Hill et al.
8,408,132 B2 4/2013 Lucas et al.
8,443,886 B2 5/2013 Torres et al.
8,596,378 B2 12/2013 Mason et al.
8,943,943 B2 2/2015 Tassaroli
D723,647 S 3/2015 Oliver
9,115,572 B1 8/2015 Hardesty et al.
9,382,784 B1 7/2016 Hardesty et al.
9,494,021 B2 11/2016 Parks et al.
9,581,422 B2 2/2017 Preiss et al.
9,605,937 B2 * 3/2017 Eitschberger ..... F42C 19/12
9,702,680 B2 7/2017 Parks et al.
9,903,185 B2 2/2018 Ursi et al.
10,188,990 B2 1/2019 Burmeister et al.
10,190,398 B2 1/2019 Goodman et al.
10,273,788 B2 4/2019 Bradley et al.
10,338,030 B2 7/2019 Bittar et al.
10,429,161 B2 10/2019 Parks et al.
10,458,213 B1 10/2019 Eitschberger et al.
10,472,938 B2 11/2019 Parks et al.
D881,322 S 4/2020 Cugini et al.
10,900,334 B2 1/2021 Knight et al.
11,078,762 B2 8/2021 Mauldin et al.
11,293,737 B2 4/2022 Sullivan et al.
11,641,371 B2 * 5/2023 Al Jarri ..... G06F 16/283 726/23
2004/0216632 A1 11/2004 Finsterwald
2004/0216866 A1 11/2004 Barlow et al.
2005/0211467 A1 9/2005 Ratanasirigulchia et al.
2009/0151589 A1 6/2009 Henderson et al.
2009/0159285 A1 6/2009 Goodman
2010/0005992 A1 1/2010 Crawford
2010/0011945 A1 1/2010 Loehr
2010/0024674 A1 2/2010 Peeters et al.
2010/0230163 A1 * 9/2010 Hales ..... E21B 43/119 175/4.51
2010/0300750 A1 12/2010 Hales et al.
2011/0024116 A1 2/2011 McCann et al.
2012/0018157 A1 1/2012 Gill et al.
2012/0138286 A1 6/2012 Mason et al.
2012/0152542 A1 6/2012 Le
2012/0180678 A1 7/2012 Kneisl
2012/0199352 A1 8/2012 Lanclos et al.
2012/0247769 A1 10/2012 Schacherer et al.
2012/0247771 A1 10/2012 Black et al.
2013/0043074 A1 2/2013 Tassaroli
2013/0048376 A1 2/2013 Rodgers et al.
2013/0153205 A1 6/2013 Borgfeld et al.
2014/0312752 A1 10/2014 Durisotti et al.
2014/0338552 A1 11/2014 Mace et al.
2015/0330192 A1 11/2015 Rogman et al.
2016/0356132 A1 12/2016 Burmeister et al.
2017/0176152 A1 6/2017 Goodman
2017/0211363 A1 7/2017 Bradley et al.
2017/0275976 A1 9/2017 Collins et al.
2018/0299239 A1 10/2018 Eitschberger et al.
2018/0306010 A1 10/2018 Von Kaenel et al.
2019/0040722 A1 2/2019 Yang et al.
2019/0186241 A1 6/2019 Yang et al.
2019/0195054 A1 6/2019 Bradley et al.
2019/0257181 A1 8/2019 Langford et al.
2019/0292887 A1 9/2019 Austin, II et al.
2019/0353013 A1 11/2019 Sokolove et al.
2020/0018139 A1 1/2020 Eitschberger et al.
2020/0024934 A1 1/2020 Eitschberger et al.
2020/0024935 A1 1/2020 Eitschberger et al.
2020/0048996 A1 2/2020 Anthony et al.
2020/0072029 A1 3/2020 Anthony et al.
2020/0217635 A1 7/2020 Eitschberger
2020/0256167 A1 8/2020 Gupta et al.
2021/0055092 A1 * 2/2021 Sullivan ..... F42D 1/05
2022/0074719 A1 3/2022 Yang
2022/0154559 A1 5/2022 Sadler et al.
2022/0213767 A1 7/2022 Prisbell et al.
2022/0290960 A1 9/2022 Prisbell et al.
2022/0333906 A1 10/2022 Lowe et al.
2023/0131652 A1 4/2023 Loehken
2023/0323759 A1 * 10/2023 Eitschberger ..... E21B 43/117 166/297

FOREIGN PATENT DOCUMENTS

CN 2244095 Y 1/1997
CN 101498209 A 8/2009
CN 101575965 A 11/2009
EP 132330 A2 1/1985
EP 0175439 A2 3/1986
EP 0601880 A2 6/1994
EP 0919694 A2 6/1999
EP 1930541 A2 6/2008
EP 2268893 B1 11/2018
RU 73390 U1 5/2008
RU 78521 U1 11/2008
RU 121054 U1 10/2012
RU 2561828 C2 9/2015
SU 258201 A1 12/1969
WO 2001096807 A2 12/2001
WO 2011080291 A2 7/2011
WO 2012135101 A2 10/2012
WO 2013180765 A1 12/2013

(56) References Cited

FOREIGN PATENT DOCUMENTS

| | | | | |
|---|---|---|---|---|
| WO | 2014089194 | A1 | 6/2014 | |
| WO | 2014179669 | A1 | 11/2014 | |
| WO | 2018026952 | A1 | 2/2018 | |
| WO | 2018213782 | A1 | 11/2018 | |
| WO | 2020232242 | A1 | 11/2020 | |
| WO | WO-2021122797 | A1 * | 6/2021 | ..... E21B 43/117 |

OTHER PUBLICATIONS

Communication article 94-3 issued in the related EP application 13860417.8, dated Jan. 19, 2018 (5 pages).
Communication article 94-3 issued in the related EP application 13860417.8, dated Mar. 8, 2017 (6 pages).
Communication article 94-3 issued in the related EP application 13860417.8, dated Mar. 9, 2016 (6 pages).
Decision of Grant issued in the related RU application 2015126872, dated Dec. 1, 2016 (12 pages).
English translation of Exam Report issued in the related AR Patent Application No. 20140101829, dated Aug. 30, 2021, 2 pages.
European Search Report issued in the related EP application 13860417.8, dated Feb. 22, 2016 (6 pages).
Exam Report issued in the related AR Patent Application No. 20140101829 dated Apr. 16, 2020, 5 pages.
Exam Report issued in the related CA Application 2892378 dated Nov. 15, 2019, 4 pages.
H-2 Perforating System, Titan division, 2019 (1 page).
International Preliminary Report on Patentability issued in the PCT Application PCT/US2020/017262 dated Aug. 19, 2021, 11 pages.
International Preliminary Report on Patentability issued in the PCT Application PCT/US2020/032879 dated Nov. 25, 2021, 8 pages.
International Preliminary Report on Patentability issued in the related PCT application PCT/US2013/073094, dated Jun. 9, 2015 (5 pages).
International Preliminary Report on Patentability issued in the related PCT application PCT/US2014/036541, dated Nov. 3, 2015 (09 pages).
International Search Report and Written Opinion issued in the PCT Application PCT/US2020/017262 dated Jun. 19, 2020, 13 pages.
International Search Report and Written Opinion issued in the PCT Application PCT/US2020/032879, dated Aug. 28, 2020 (10 pages).
International Search Report and Written Opinion issued in the related PCT application PCT/US2013/073094, dated Mar. 20, 2014 (9 pages).
International Search Report and Written Opinion issued in the related PCT application PCT/US2014/036541, dated Sep. 12, 2014 (13 pages).
Merriam-Webster Dictionary, multiple various definitions for the term "bulkhead", published in Jan. 2013. (Year: 2013).
Notice of Allowance issued in U.S. Appl. No. 16/021,061 dated Aug. 11, 2021, 8 pages.
Office action issued in the related CN application 201380062953.4, dated Feb. 27, 2018 (11 pages).
Office action issued in the related CN application 201380062953.4, dated Jun. 15, 2017 (20 pages).
Office action issued in the related CN application 201380062953.4, dated Sep. 1, 2016 (22 pages).
Office action issued in the related RU application 2015126872, dated Aug. 19, 2016 (8 pages).
Office Action issued in the related U.S. Appl. No. 14/888,882 dated Dec. 3, 2021, 16 pages.
Office Action issued in the related U.S. Appl. No. 14/888,882 dated Apr. 13, 2021, 16 pages.
Office Action issued in the related U.S. Appl. No. 14/888,882 dated Jan. 30, 2020, 26 pages.
Office Action issued in the related U.S. Appl. No. 14/888,882 dated May 25, 2018 (36 pages).
Office Action issued in the related U.S. Appl. No. 14/888,882 dated Nov. 2, 2018 (24 pages).
Office Action issued in the related U.S. Appl. No. 14/888,882 dated Nov. 24, 2017 (28 pages).
Office Action issued in the related U.S. Appl. No. 16/021,061 dated Apr. 20, 2020, 20 pages.
Office Action issued in the related U.S. Appl. No. 16/021,061 dated Sep. 9, 2020, 11 pages.
Titan H2 Perforating Gun System, (2019) 2 pages, Link: https://www.oilfieldtechnology.com/product-news/07022019/hunting-introduces-h-2-perforating-system/.
Office Action issued in U.S. Appl. No. 17/235,616 on Mar. 16, 2022, 8 pages.
Notice of Allowance issued in U.S. Appl. No. 14/888,882 dated Jun. 20, 2022, 8 pages.
Extended Search issued in European Patent Application No. 20752538.7 dated Sep. 30, 2022, 8 pages.
International Search Report and Written Opinion issued in the PCT Application No. PCT/US/2021/059401 on Feb. 24, 2022, 11 pages.
International Preliminary Report on Patentability issued in the PCT Application PCT/US2021/059401 dated May 25, 2023, 8 pages.
Hunting introduces H-2 Perforating System, downloaded from https://www.oilfieldtechnology.com/product-news/07022019/hunting-introduces-h-2-perforating-system/, Oilfield Technology, Feb. 7, 2019, 2 pages.
GEODynamics, Hellfire perforating system, 2019, 2 pages.
International Search Report and Written Opinion issued in the PCT Application No. PCT/US2021/059400 dated Feb. 24, 2022, 8 pages.
International Preliminary Report on Patentability issued in the PCT Application No. PCT/US2021/059400 dated May 25, 2023, 7 pages.
Office Action issued in U.S. Appl. No. 18/252,593 dated Jul. 12, 2024, 26 pages.
Office Action issued in U.S. Appl. No. 17/595,411 dated Jul. 28, 2023, 55 pages.
Notice of Allowance issued in Chinese Patent Appl. No. 202080021773.1 on Sep. 5, 2023; 8 pages.
Office Action and Search Report issued in Russian Patent Appl. No. 2021136889 on Sep. 4, 2023; 14 pages (with English translation).
Notice of Allowance issued in Design U.S. Appl. No. 29/750,153 on Oct. 17, 2023; 9 pages.
"Stimulation-Optimized Shaped Charges" [online]. slb.com. [Retrieved on Oct. 2, 2023]. Retrieved from the Internet: <https://www.slb.com/products-and-services/innovating-in-oil-and-gas/completions/well-completions/perforating/perforating-guns-and-charges/stimulation-optimized-shaped-charges>.
"Shaped Charges, engineered for your rock" [online]. JRC designs. [Retrieved on Oct. 2, 2023]. Retrieved from the Internet: <https ://www.jetresearch.com/en/energetics/shaped-charges>.

* cited by examiner

LARGE SHAPED CHARGE PERFORATION TOOL

CROSS-REFERENCE TO RELATED APPLICATIONS

The present application is the National Stage Entry of International Application No. PCT/US2021/059401, filed Nov. 15, 2021, which claims priority benefit of U.S. Provisional Application No. 63/198,794, filed Nov. 13, 2020, the entirety of which is incorporated by reference herein and should be considered part of this specification.

FIELD

Embodiments herein generally relate to formation perforation tools used in oil and gas production. Specifically, the embodiments here related to perforation tools that accommodate large shaped charges with continuous phasing capability.

BACKGROUND

Perforation tools are tools used in oil and gas production to form holes, passages, and/or fractures in hydrocarbon-bearing geologic formations to promote flow of hydrocarbons from the formation into the well for production. The tools generally have explosive charges shaped to project a jet of reaction products, including hot gases and molten metal, into the formation. The tool has a generally tubular profile, and includes support frames, ignition circuits, and wiring for activating the charges and communicating signals and/or data along the tool. The charges are generally shaped like a cone or a bell, and electricity is commonly delivered to the narrow end of the charge by an electrical conductor positioned at the narrow end of the charge and connected by wire to ignition sources and other shaped charges.

Larger charges produce more perforation, and are therefore generally preferred. Conversely, smaller tools require smaller, less costly bores, and are therefore equally preferred. Thus, there is always a need for perforation tools having minimum diameter where charge size is maximized.

Flexibility is also appreciated in perforation tools. Often, there is a desire to perforate in one direction or another, or in many directions. The ability to perforate in more than one direction, and even to select directions during operation, is useful. Thus, perforation tools that employ large shaped charges in small tools with flexibility to phase ejection angle of the shaped charges are always in demand.

SUMMARY

Embodiments described herein provide a perforation tool, comprising a container with a longitudinal axis; an initiator module in the container, the initiator module having a firing circuit, an electrical contact at the longitudinal axis, and a detonator housing; and a shaped charge frame in the container, the shaped charge frame having a first end; a second end opposite the first end; a recess for accepting a shaped charge between the first end and the second end, the recess having a wide end and a narrow end, wherein the longitudinal axis is between the wide end and the narrow end; a first electrical contact at the first end, the first electrical contact located at the longitudinal axis; a second electrical contact at the second end, the second electrical contact located at the longitudinal axis; an electrical conductor connecting the first and second contacts; and a ballistic pathway coupling the detonator housing to the narrow end of the recess.

Other embodiments described herein provide a frame for a shaped charge, the frame comprising a body having a central longitudinal axis, a first end, a second end opposite the first end; a receptacle for a shaped charge, the receptacle having a wide end and a narrow end, wherein the central longitudinal axis is between the wide end and the narrow end; an electrical conductor disposed in a passage through a periphery of the frame from the first end to the second end of the frame; and a ballistic pathway disposed in the frame adjacent to the narrow end of the receptacle and fluidly coupled to an opening in the first end of the frame.

Other embodiments described herein provide a bulkhead member for a perforation tool, the bulkhead member comprising a cylindrical body with a first end and a second end; and an electrical conductor disposed within the cylindrical body from the first end to the second end, the electrical conductor having a pin connection at the first end and a box connection at the second end.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The perforation tools described herein use frames for shaped charges that accommodate large charges that extend across the diameter of the tool, which is generally tubular or cylindrical, and that provide ballistic and electrical transfer integrated into the frame. Some embodiments herein are also indexable so that individual frames can point the shaped charges in different directions that can be selected, while maintaining ballistic transfer and electrical connectivity.

Figure 1A:
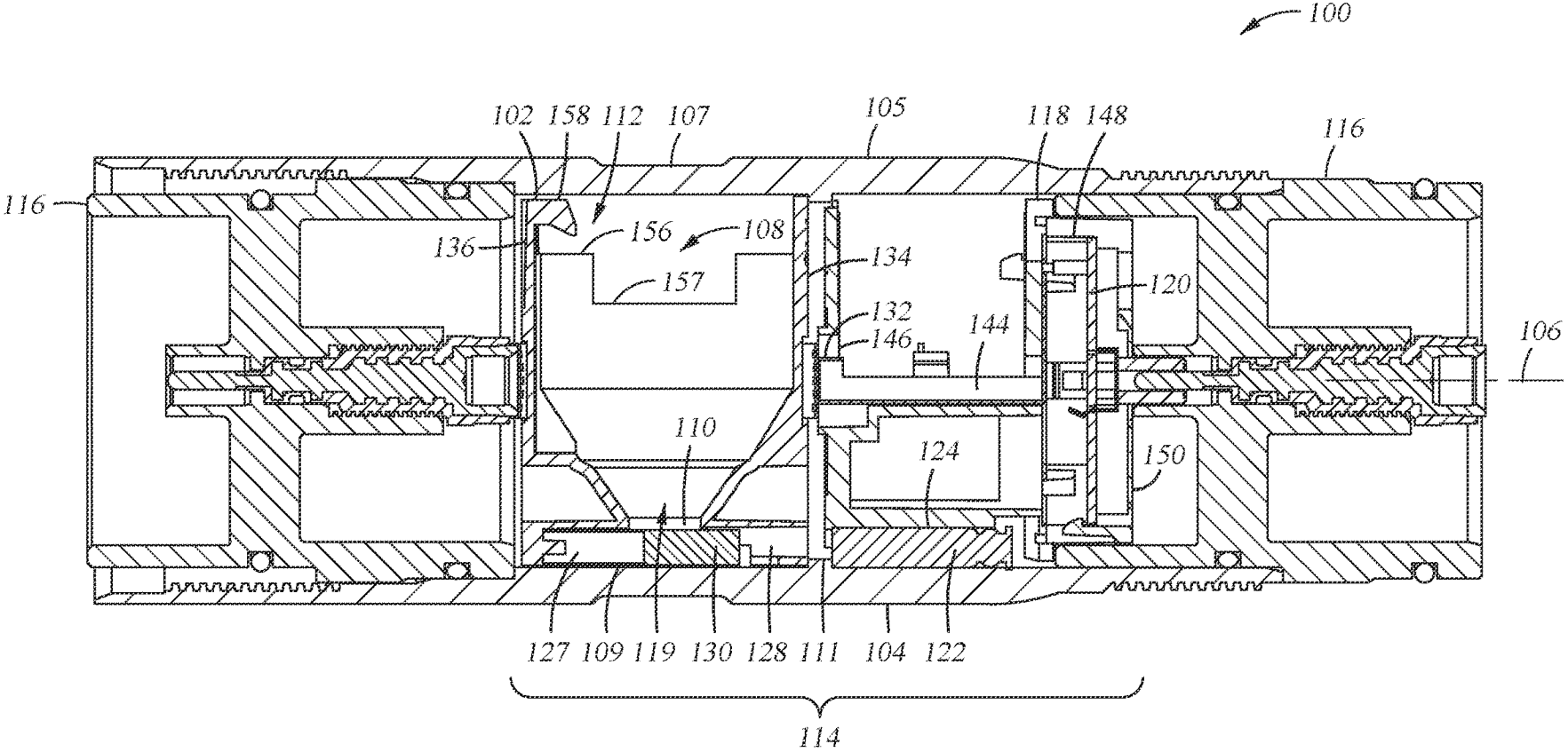
FIG. 1A is a cross-sectional view of a perforation tool 100 according to one embodiment.

FIG. 1A is a cross-sectional view of a perforation tool 100 according to one embodiment. The perforation tool 100 uses one or more frames 102 to hold shaped charges in a container 104. The tool 100 is deployed in a well drilled into a formation. When activated, the shaped charges produce a jet of reaction products that pierce the container 104 and penetrate the formation to facilitate recovery of resources from the formation. The container 104 has an outer wall 105 with a reduced thickness zone 107 at a location adjacent to a frame cavity 109 of the container 104. The frame cavity 109 is defined by a ledge 111 extending inward from the outer wall 105. The ledge 111 supports the frame 102 at the desired location adjacent to the reduced thickness zone 107, and may extend entirely around the circumference of the container 104, or partway, or piecewise around the circumference of the container 104. The reduced thickness zone 107 may form a band around the container 104. Thus, the reduced thickness zone 107 may be a continuous zone that circumscribes the outer wall 105 of the container 104. In some cases, the ledge 111 may be replaced by a short stub that extends inward from the outer wall 105. The reduced thickness zone 107 may alternately be a zone that proceeds partway around the container 104. The reduced thickness zone 107 allows for penetration of reaction products through the container 104. Using a band around the circumference of the container 104 allows the frame 102 to be positioned in any desired rotational orientation to provide a jet in the desired direction.

Typically, frames for shaped charges have one or more recesses to hold the shaped charges. The recesses generally have a cone or bell shape, or another shape generally tapering from a wide edge that accommodates the wide end of a shaped charge, to a narrow apex where the corresponding apex of the shaped charge fits. Shaped charge frames have generally cylindrical shapes with a central axis that aligns with, or coincides with, a central axis of the container when installed. The recesses also have central axes that are typically perpendicular to the central axis of the frame. The recesses typically have a wide end and a narrow end that defines an apex of the recess. The shape of the recess is usually defined to follow the shape of the charge to be installed in the recess.

In some cases, the wide end and narrow end of the recess are on the same side of the central axis of the frame, with the apex near the central axis so that communication of various sorts can be deployed along the central axis of the frame. In this way, the apex of the shaped charge can be positioned near the central axis of the frame so the shaped charge can be activated using communication along the central axis of the frame. In such cases, the apex of the recess is between the central axis of the frame and the wide end of the recess. This typically enables positioning multiple recesses around the axis of the charge frame, potentially at the same axial coordinate, with one communication path for all recesses extending along the central axis. Such construction limits the size of the charge that can be installed in the perforation tool.

Other tools have large shaped charges where the central axis of the frame is between the narrow and wide ends of the recess, such that the bulk of the shaped charge extends substantially across the tool from one side to the other. Such shaped charges allow for larger, more penetrating, discharges using a relatively small tool, but the central communication conduit feature described above is not available in such frames. The tools described herein use frames for large shaped charges that have integrated electrical and ballistic communication in a modular construction that is, in many cases, freely indexable to any direction.

The tool 100 has a generally cylindrical shape, and defines a longitudinal axis 106. In the perforation tool 100, the frames 102 have a generally cylindrical shape, with a central axis that coincides with the longitudinal axis 106 when the frame is deployed in the tool 100. Each frame 102 has one recess 108 for holding a shaped charge. When the frame 102 is deployed in the tool 100, the longitudinal axis 106 is located between a narrow end 110 of the recess 108 and a wide end 112 of the recess 108. The recesses 108 in the frames 102 of FIG. 1A can thus hold larger shaped charges than frames with recesses that do not extend across the longitudinal axis 106.

The frame 102 is generally made of plastic, or another material having a certain flexibility. The frame 102 can be molded or 3-d printed, for example, from a tough flexible plastic like polypropylene or polyurethane.

The recess 108 is configured to hold a shaped charge (not shown) that has a wide end and a narrow end. The shaped charge fits in the recess 108 with the wide end of the shaped charge at the wide end 112 of the recess 108 and the narrow end of the shaped charge at the narrow end 110 of the recess 108. The wide end 112 of the recess 108 has a rim 156 that generally secures the shaped charge in the recess 108. The wide end 112 of the recess 108 also has a tab 158 that flexes to capture the wide end of the shaped charge, thus securing the shaped charge into the recess 108. The rim 156 of the recess 108 may have a finger notch 157 to facilitate insertion and removal of shaped charges. The narrow end 110 of the recess 108 has an opening 119 for electrical and/or ballistic communication at the apex of the shaped charge.

The perforation tool 100 has one or more energy modules 114 with a bulkhead member 116 at either end of the energy module 114. Where multiple energy modules are used, a bulkhead member 116 separates one energy module 114 from a neighboring energy module 114. The bulkhead member 116 is a hard, solid mass, usually steel, that fits into an end of the container 104, thus sealing the energy module 114 inside the container 104. The bulkhead members 116 minimize transmission of energy from an energy module 114 beyond the bulkhead member 116. The bulkhead member 116 may be connected to the container 104 using a threaded connection or using a non-threaded connection. Here, a non-threaded connection is shown.

The energy module 114 comprises one or more charge frames 102, as described above, along with an initiator module 118 between the charge frame 102 and the bulkhead member 116. The initiator module 118 contains circuitry to produce an electrical impulse that activates the shaped charge in the recess 108. The circuitry is typically housed in a circuit board 120 oriented transverse to the central axis 106 of the tool 100. The electrical impulse is used to activate a detonator 122 housed by the initiator module 118 and electrically coupled to the circuit board 120.

The initiator module 118, in this case, has two locations for housing the detonator 122. As shown in FIG. 1A, a first detonator housing 124 is located in a peripheral area of the initiator module 118. The detonator 122 is shown installed in the first detonator housing 124 in FIG. 1A. An opening 126 of the detonator housing 124 is aligned with an opening 128 of the frame 102. The opening 126 provides fluid communication between the detonator housing 124 and a capsule housing 127 of the frame 102. An activation capsule 130 is disposed in the opening 128 of the frame 102. Activation of the detonator 122 creates an energy discharge that travels through the opening 126 of the detonator housing 124 into the opening 128 of the frame 102 and activates the capsule 130. Activation of the capsule 130, in turn, creates an energy discharge that travels through the opening 119 at the narrow end 110 of the recess 108 and activates the shaped charge disposed in the recess 108.

Figure 1C:
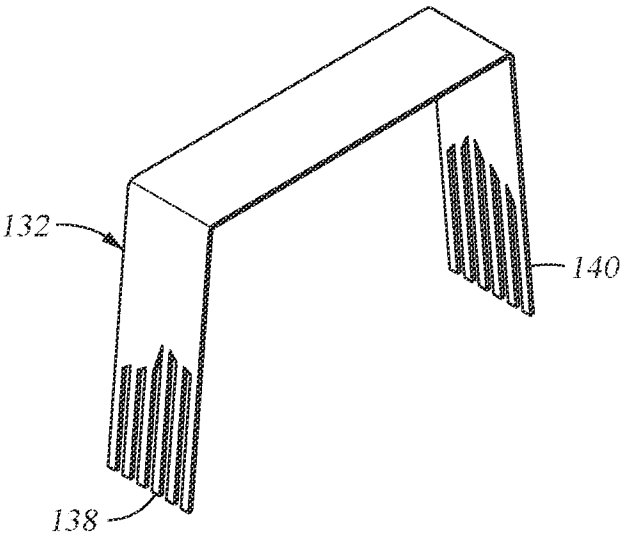
FIG. 1C is an isometric view of an electrical contact of the frame shown in FIG. 1A.
Figure 1B:
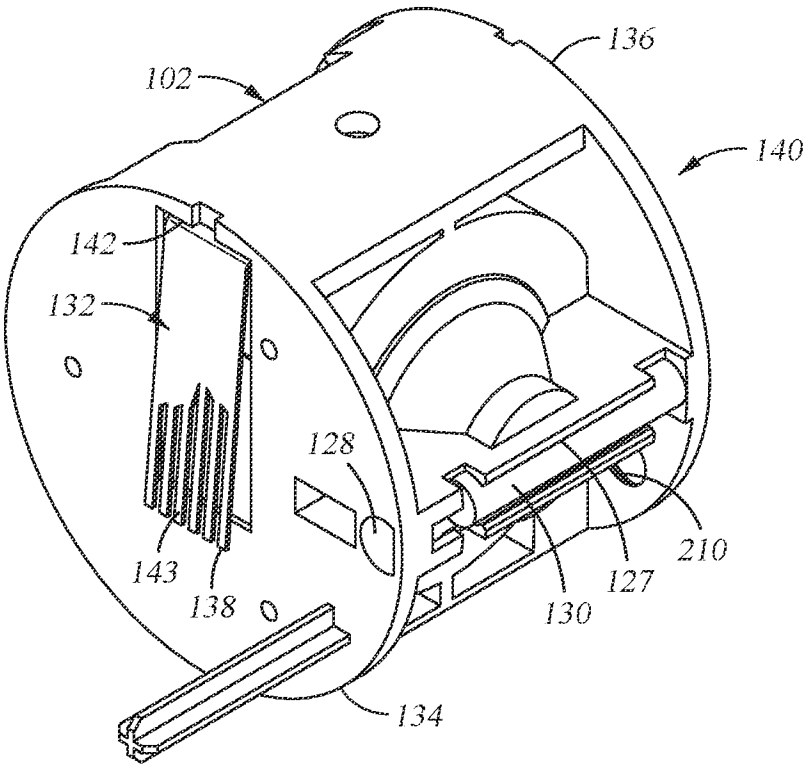
FIG. 1B is a back view of a frame shown in FIG. 1A.

The frame 102 provides electrical connectivity from the initiator module 118 to other modules that may be installed in the tool 100. The frame 102 has an electrical conductor 132 that extends from a first end 134 of the frame 102 to a second end 136 of the frame 102 opposite from the first end 134. FIG. 1B is a back view of the frame 102 of FIG. 1A. FIG. 1C shows the electrical conductor 132. The electrical conductor 132 is a band or wire with a first end 138, which is located at the first end 134 of the frame 102, and a second end 140, which is located at the second end 136 of the frame 102. The electrical conductor 132 is angled in a square "U" shape so that the ends 138 and 140 can be located near the center of their respective sides of the frame 102 while a central portion 141 of the electrical conductor 132, between the first and second ends 138 and 140, is located near a side of the frame 102 and forms an angle with the first and second sides 138 and 140. The electrical conductor 132 is disposed with the central portion 141 in a passage 142 in a side of the frame 102, so the electrical conductor 132 is detachably integrated with the frame 102. Specifically, the electrical conductor 132 can be detached from the frame 102 by sliding the electrical conductor 132 out of the passage 142. If necessary, one or both of the first and second ends 138 and 140 can be straightened with respect to the central portion 141 to facilitate insertion or removal. For example, prior to insertion, one of the first or the second end 138/140 can be substantially parallel with the central portion 141 for insertion into the passage 142. After insertion into the passage 142, the "unbent" end can be bent into proximity with the central portion of the side of the frame 102. Likewise, to remove the electrical conductor 132, one end can be "unbent" to allow easy removal.

The first end 138 of the electrical conductor 132 is located near a center of the first end 134, where the central axis 106 intersects the first end 134, and the second end 140 is located near a center of the second end 136, where the central axis 106 intersects the second end 136. The electrical conductor 132 extends around a periphery of the frame 102 from the first end 134 to the second end 136 thereof. The electrical conductor 132 is a flat-spring-type contact with the first and second ends 138 and 140 extending away from the respective first and second ends 134 and 136 of the frame 102 at an angle. When the frame 102 is disposed in the container 104, the ends 138 and 140 of the electrical conductor 132 contact other electrical members of the tool 100 and flex to provide a contact force for secure electrical contact. In this way, electrical continuity across the frame 102 is maintained. The ends 138 and 142 are shown with connectivity enhancing features 143, in this case fingers that make the ends 138 and 142 comblike. Any connectivity enhancing features can be used, including different shapes and compositions. For example, a coating, or small spot, of highly conductive material, such as gold, can be applied to the electrical conductor 132 to enhance connectivity. Alternately, a brush-like or wool-like conductive material can be used at the ends 138 and 140 to enhance electrical connectivity.

The electrical conductor 132 provides electrical continuity from a central area of the first end 134 to a central area of the second end 136 passing along a periphery of the frame 102. The flat-spring ends of the electrical conductor 132 provide resilient, deformable electrical contacts for securing electrical continuity at both ends of the frame. In other embodiments, resilient electrical contacts may be located at the central areas of the first end 134 and the second end 136, and the resilient electrical contacts can be electrically coupled to an electrical conductor disposed within the frame in a non-removable manner. The resilient electrical contacts may be any kind of spring, such as a flat spring or coil spring, and may be electrically coupled to the electrical conductor at any location between the central area of the frame ends and a peripheral area of the frame ends. Different types of resilient electrical contacts can be used at the ends of the frame, if desired.

Referring again to FIG. 1A, the electrical conductor 132 may be electrically coupled to the initiator module 118 by contact with an electrical member 144 of the initiator module 118 disposed along the central axis 106. The electrical member 144 extends from a contact surface at a first end 146 of the initiator module 118 to an electrical assembly 148 at a second end 150 of the initiator module 118. The electrical member 144 contacts the electrical conductor 132 of the frame 102 at the first end of the initiator module 118 to provide electrical feedthrough to the frame 102.

Figure 2:
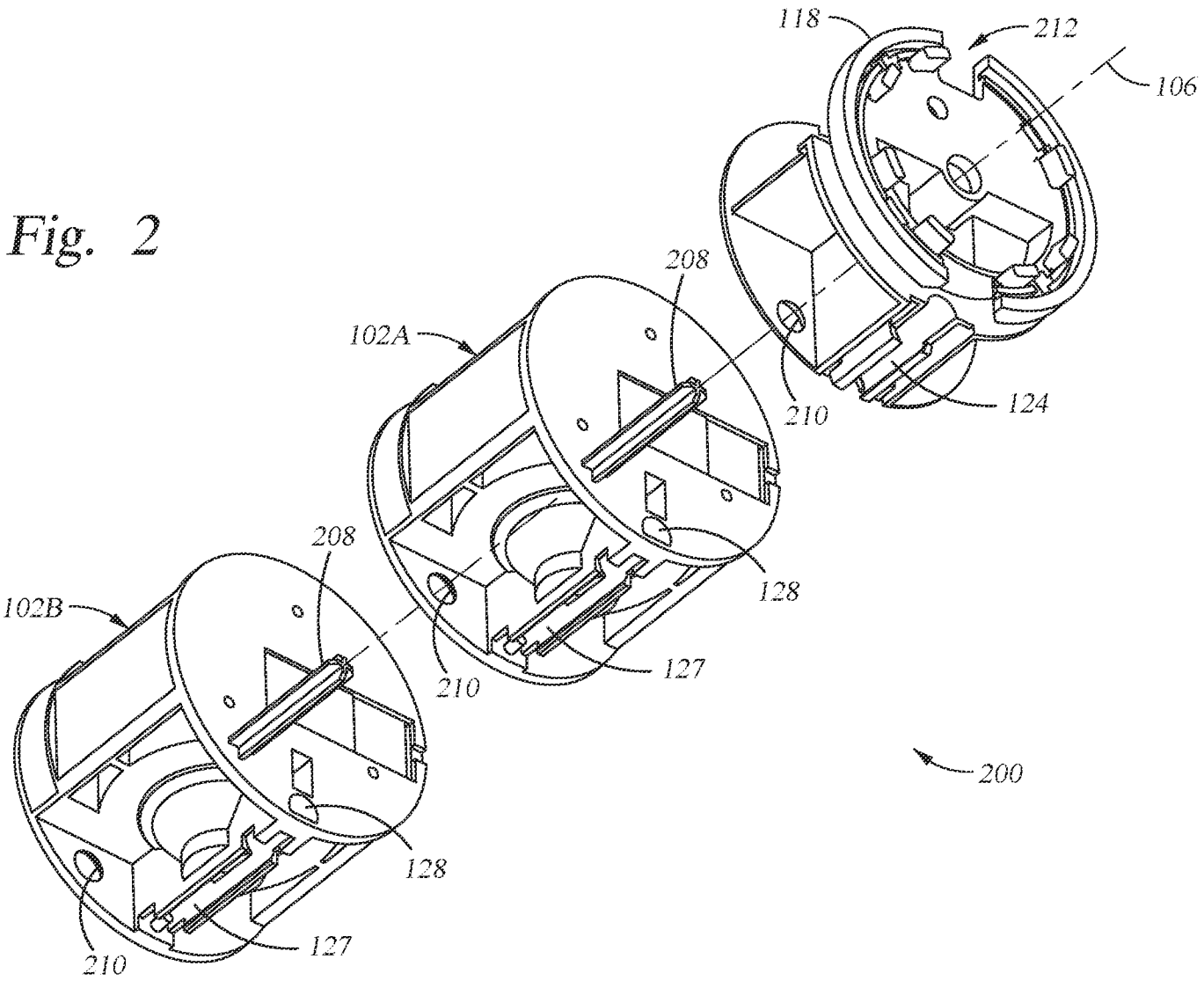
FIG. 2 is an exploded view of an energy module useable in a perforation tool, according to one embodiment.

The frame 102 is stackable with other frames. Specifically, more than one of the frames 102 can be included in a perforation tool. FIG. 2 is an exploded view of an energy module 200 useable in a perforation tool, according to one embodiment. The energy module 200 features the initiation module 118 with two shaped charge frames 102, a first shaped charge frame 102A and a second shaped charge frame 102B. The initiation module 118, first shaped charge frame 102A, and second shaped charge frame 102B have alignment features that preserve alignment of the ballistic communication pathway that activates the shaped charges in the frames 102A and B. Each of the frames 102A and B has a post 208 for mating with an opening 210 to maintain alignment. The initiator module 118 also has one of the openings 210 to align with the first shaped charge 204.

The alignment features maintain alignment of ballistic communication pathways. Specifically, the first and second charge frames 102A and 102B each have the capsule housing 127 and the opening 128. Together with the first detonator housing 124, the openings 128 and capsule housings 127 provide a fluid communication pathway from the first detonator housing 124 to the narrow ends of the recesses 108 of the first and second charge frames 102A and B to activate charges in the frames 102A and B. The alignment features can take any form or configuration, such as pumps, posts, tabs, and the like, with the openings taking any commensurate shape as well. It should be noted that any number of charge frames 102 can be used in this way in the energy module 200.

Here, the posts 208 extend in a direction parallel to the central axis 106. Each post 208 is spaced apart from the longitudinal axis 106 by an arbitrary distance. In this case, each post 208 and each opening 210, is located near an outer edge of the frames 204 and 206, and the initiator module 202. Thus, all the components of the energy module 200 can be maintained in alignment. If a particular alignment within the container 104 (FIG. 1) is desired, a notch 212 in the edge of the initiator module 202 can be engaged with a ridge (not shown) that can be provided along an interior wall of the container 104 to align all the members of the energy module.

Figure 3:
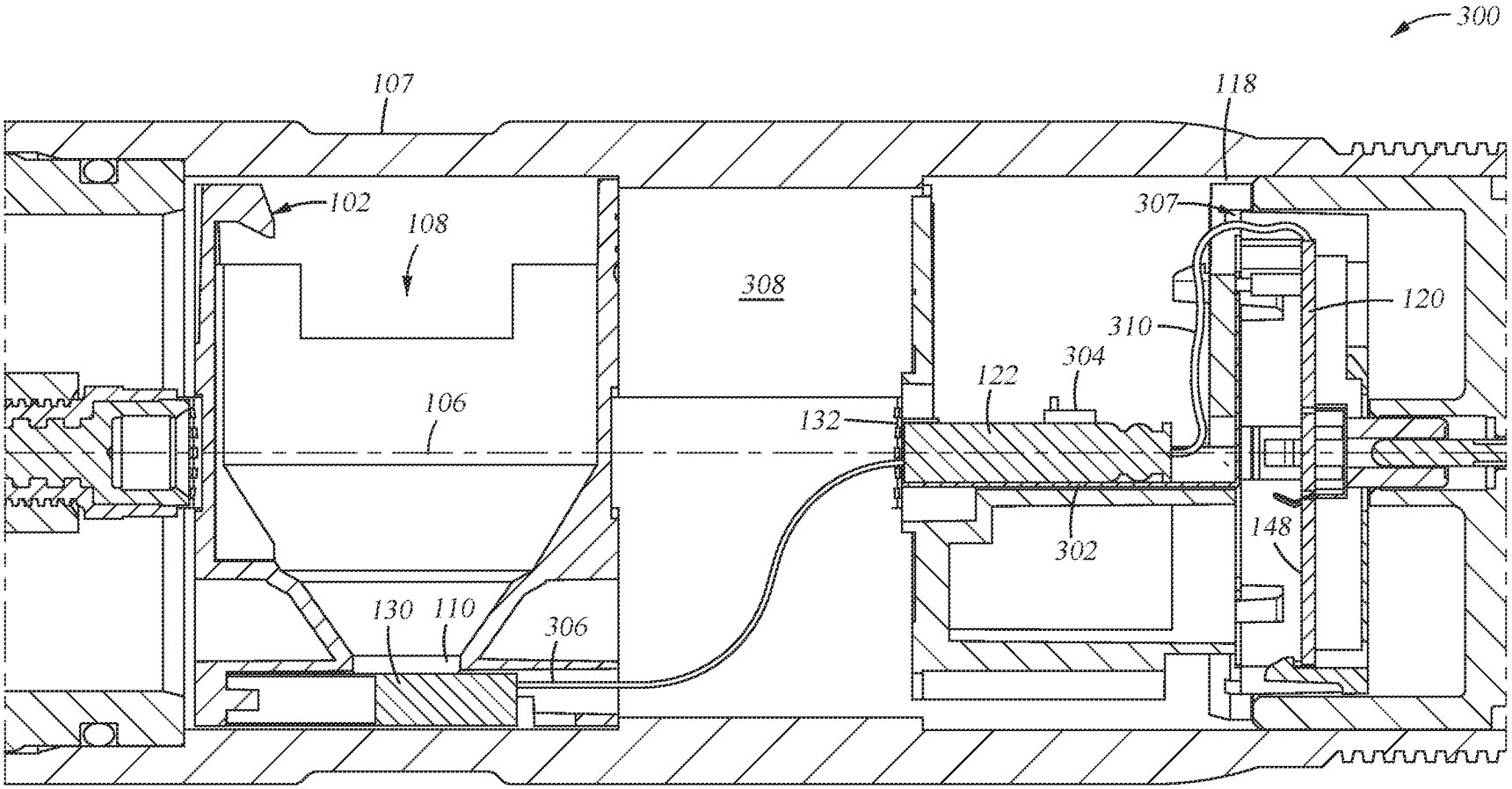
FIG. 3 is a cross-sectional view of a perforation tool according to another embodiment.

FIG. 3 is a cross-sectional view of a perforation tool 300 according to another embodiment. The initiator module 118 has a second detonator housing 302 located along the central axis of the initiator module 118, which coincides with the central axis 106 of the tool 300. The second detonator housing 302 is a tubular member that can hold a detonator such as the detonator 122. Here the second detonator housing 302 is a "half-pipe" in which the detonator 122 rests, with a clip 304 that holds the detonator 122 in the half-pipe. Electrical leads 310 from the detonator 122 may be routed to the circuit board 120 in any convenient way. In this case, the leads are routed through a peripheral opening 307 into the electrical assembly 148.

In the perforation tool 300, the detonator 122 is not physically aligned with the capsule 130, but is centrally located along the central axis 106 of the tool 300. Ballistic transfer from the detonator 122 to the capsule 130 can be achieved by routing a combustible conduit 306 between the detonator 122 and the capsule 130 through a gap 308 between the frame 102 and the initiator module 118. The gap 308 is maintained by a spacing force provided by the electrical conductor 132. As noted above, the ends of the electrical conductor 132 are configured as flat springs to provide the spacing force to maintain the gap 308. The combustible conduit 306 may be a detonation cord or other combustible conduit, and is routed from a location near the detonator and the end of the electrical conductor 132 to a location near the capsule 130 in the capsule housing 127. Upon activation of the detonator 122, energy transfers to the combustible conduit 306, and along the combustible conduit 306 to the capsule 130, which in turn activates the shaped charge in the frame 102. In such embodiments, the frame 102 can be oriented in any desired direction to provide a perforating jet in the desired direction, while maintaining electrical and ballistic continuity. To accomplish such rotatability, the alignment features mentioned above in connection with FIG. 2 can be eliminated, or in other embodiments multiple openings 210 can be provided in the initiator module 118 to engage with the post 208 in multiple indexed orientations.

Figure 4:
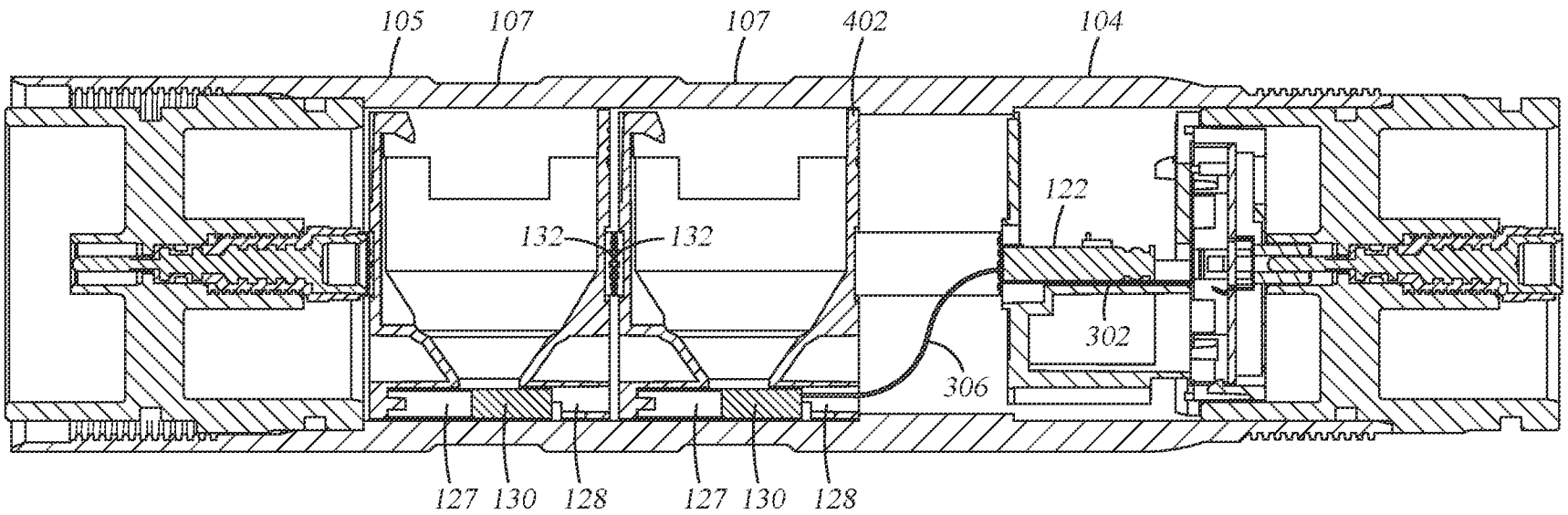
FIG. 4 is a cross-sectional view of a perforation tool according to another embodiment.

FIG. 4 is a cross-sectional view of a perforation tool 400 according to another embodiment. The perforation tool 400 uses a plurality of shaped charge frames 402. The shaped charge frames 402 are slightly different from the frames 102 in that each frame has the opening 128 that provides ballistic transfer to the capsules 130, but each frame 402 has an outlet 404 of the conduit 127 that provides a fluid pathway for the capsule 130 of one frame 402 to transfer energy to the capsule of an adjacent frame 402 through the conduits 127 of the frames. Any number of the frames 402 can be used in this way to activate an arbitrary number of shaped charges. Electrical continuity is provided across all the frames 402 by electrical contact of the conductors 132 of the adjacent frames 402. In this case, alignment of the conduits 127 is maintained using alignment features such as those described above in connection with FIG. 2. It should be noted that, although the detonator 122 is shown in FIG. 4 in the central location, using the second detonator housing 302 and the combustible conduit 306, the detonator 122 could be located in the first detonator housing 124. It should also be noted that, where multiple frames are used in an energy module, as shown in FIG. 4, each frame will have a corresponding reduced thickness zone 107 in the outer wall 105 of the container 104.

Figure 5:
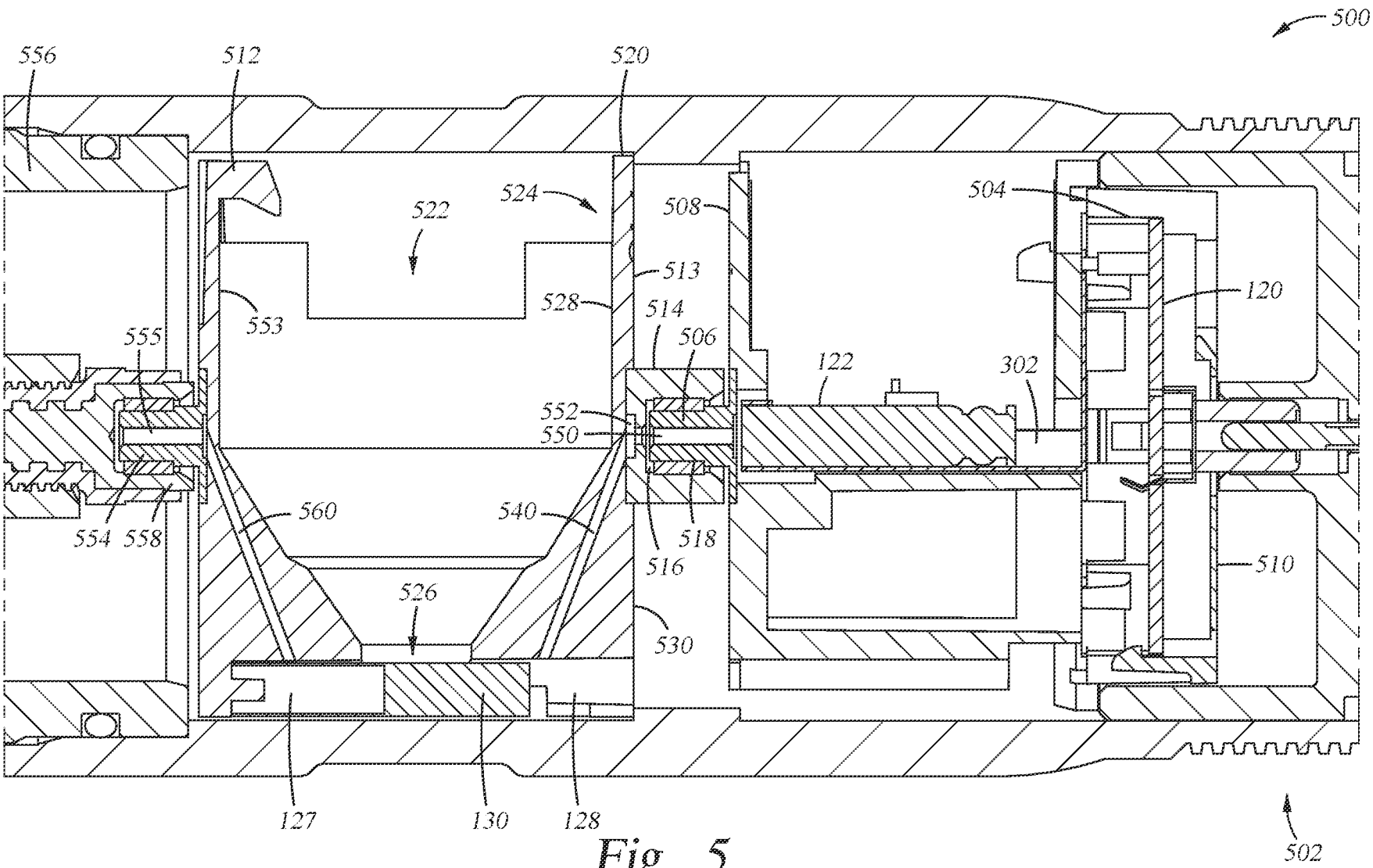
FIG. 5 is a cross-sectional view of a perforation tool according to another embodiment.

FIG. 5 is a cross-sectional view of a perforation tool 500 according to another embodiment. The tool 500 uses an energy module 502 with different features from those of the other perforation tools described above. The energy module 502 has an initiator module 504 with a hollow pin connector 506 at a first end 508 of the initiator module 504. The circuit board 120 is located at a second end 510 of the initiator module 504, as in other embodiments herein.

The energy module 502 uses a shaped charge frame 512 that has a pocket electrical connector 514 at a first end 513 of the frame 512. The pocket connector 514 features a recess 516 with a plurality of bearings 518 disposed therein. The bearings 518, in this case, are cylindrical roller bearings. The pocket connector 514 is coupled to the electrical conductor 132 (FIG. 1C), not shown in FIG. 5. To provide electrical continuity across the frame 512, the pin connector 506 of the initiator module 504 engages with the pocket connector 514 by inserting into the recess 516. Here, the pin connector 506 is axially rigid with no axial movement capability such as spring-loading or extension/retraction. The bearings 518 make contact with the pin connector 506, providing electrical continuity between the initiator module 504 and the frame 512. In some embodiments, instead of a plurality of roller bearings, a single band bearing, configured as a hollow cylinder, can be used as a bearing in the recess 516. In other embodiments, the pin connector 506 and pocket connector 514, which may be a box connector, make direct electrical contact without the use of a bearing, and the pin connector 506 is able to rotate within the pocket connector 514 while maintaining electrical connection.

Ballistic continuity is provided by a tunnel 540 formed through the frame 512. The frame 512 has an outer wall 520 that contains the shaped charge within a recess 522. The recess 522 has a wide end 524 and a narrow end 526. The outer wall 520 has a thin portion 528 at the wide end 524 and a thick portion 530 at the narrow end 526. The thickness of the thick portion 530 increases from a middle location of the outer wall 520, about midway between the narrow end 526 and the wide end 524, toward the narrow end 526. The tunnel 540 extends from the pocket connector 514 to the capsule housing 127 adjacent to the narrow end 526 of the recess 522. The tunnel 540 provides fluid communication between the second detonator housing 302 and the capsule housing 127, and is shaped and positioned to support ballistic continuity from the detonator to the capsule 130. The pin connector 506 has a passage 550 formed therein, along a longitudinal axis thereof. The passage 550 is in fluid communication with the second detonator housing 302. The pocket connector 514 has an opening 552 that provides fluid communication between the tunnel 540 and the passage 550. The passage 550, opening 552, and tunnel 540 thus provide a continuous fluid pathway from the second detonator housing 302 to the capsule housing 127. Activation of the detonator 122 in the second detonator housing 302 projects ballistic energy along the passage 550, through the opening 552, and along the tunnel 540 to the capsule housing 127, activating the capsule 130 and the shaped charge in the recess 522.

The frame 512 has a pin connector 554 at a second end 553 of the frame 512 opposite from the first end 513. The pin connector 554 is substantially similar to the pin connector 506, and is suitable for engaging with a pocket connector of another component. Here, a bulkhead member 556 is shown connected to the frame 512 by a pocket connector 558 substantially similar to the pocket connector 514 of the frame 512. The pin connector 554 also has a longitudinal passage 555 for fluid continuity, should fluid continuity at the pin connector 554 be desired.

The frame 512 has an optional second tunnel 560 that extends from the capsule housing 127 to the pin connector 554. Where the frame 512 has a second tunnel 560, the tunnel 540 is a first tunnel, and the first and second tunnels 540 and 560 provide a fluid pathway through the frame 512 from the pocket connector 506, past the narrow end 526 of the recess 522 through the capsule housing 127, to the pin connector 554, a continuous fluid pathway through the frame 512 from the first end 528 to the second end 553. The optional second tunnel 560 can be used to provide ballistic continuity across the frame 512, so that activation of the capsule 130 can provide ballistic energy transfer from the frame 512 to another component, such as another frame 512, connected to the frame 512. Because the pin and pocket connectors 506, 514, 554, and 558 are rotatably engaged using roller bearings, the frame 512 is free to rotate to any angle while maintaining electrical continuity. The passage 550, opening 552, and tunnel 540 provide fluid continuity at any rotation angle of the frame 512, and the second tunnel 560 and passage 555 provide outlet fluid continuity from the capsule housing 127 to the pin connector 554 at any rotation angle of the frame 512. In this way, the frame 512 has integral electrical and ballistic continuity, and is rotatable to any angle to direct discharge from the shaped charge in any desired direction.

As noted above, the frame 512 uses an electrical conductor like the conductor 132 of FIG. 1C detachably disposed in a passage (FIG. 1B) through the frame 512 along a side thereof. The passage proceeds around the recess 522 and has openings at the first end 528 and the second end 553 of the frame 512. The electrical conductor provide electrical continuity across the frame from the pocket connector 514 to the pin connector 554. The tunnel 540, capsule housing 127, and second tunnel 560 form a second passage through the frame 512 from the first end 528 to the second end 553 for ballistic continuity. The second passage runs from a central area of the first end 528, adjacent to the narrow end of the recess 522, to a central area of the second end 553. The passage 550 of the pin contact 506 of the initiator module 504, together with the opening 552 in the pocket connector 514 of the frame 512, provide fluid communication between the second passage through the frame and the second detonator housing 302 of the initiator module 504. In this way, electrical and ballistic continuity are integral to the frame 512. It should be noted that ballistic conduits can be used in the tunnels 540 and 560, or combustible material may be directly inserted into the tunnels 540 and 560 for ballistic transfer.

Figure 6:
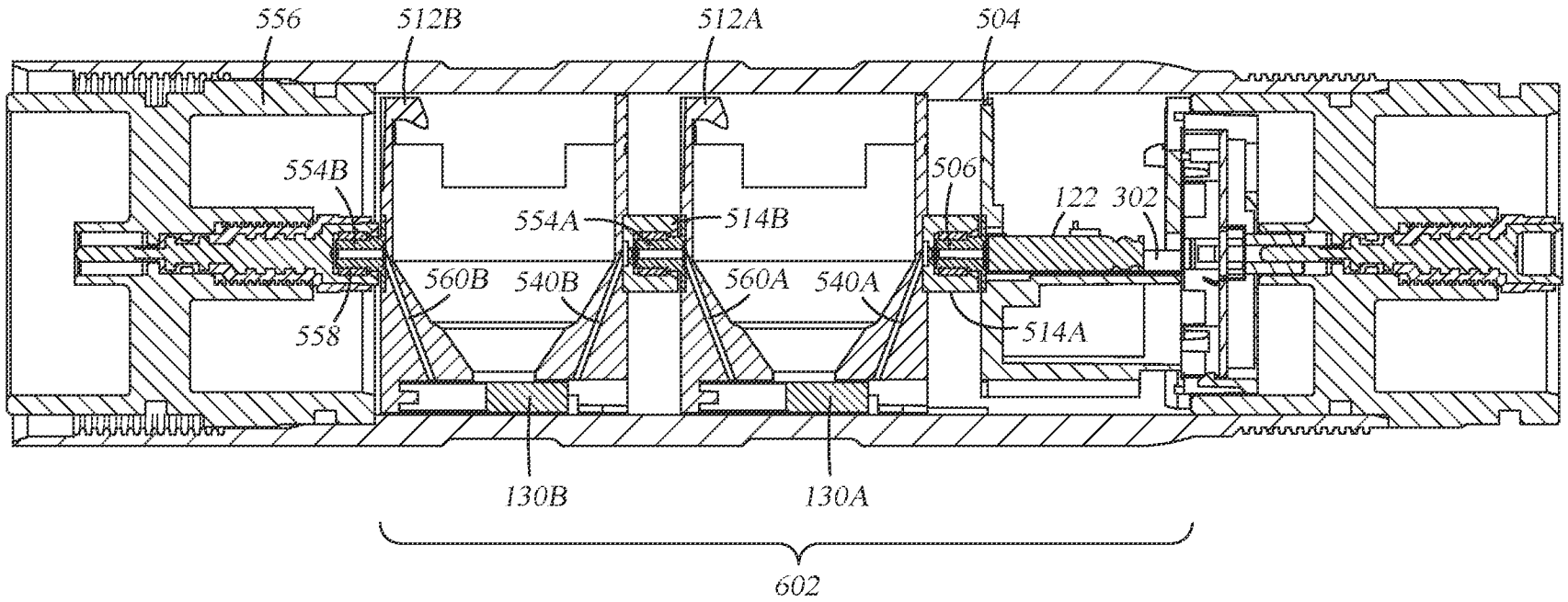
FIG. 6 is a cross-sectional view of a perforation tool according to another embodiment.

FIG. 6 is a cross-sectional view of a perforation tool 600 according to another embodiment. The perforation tool of FIG. 6 uses an energy module 602 that includes the initiator module 504 and two of the shaped charge frames 512 connected together to illustrate the electrical and ballistic continuity characteristics of the initiator module 504 and the frame 512. Here, a first frame 512A is connected to the initiator module 504 by a pin-pocket electrical connector, with the pin connector 506 of the initiator module connected to the pocket connector 514A of the first frame 512A, the pin connector 554A of the first frame 512A connected to the pocket connector 514B of the second frame 512B, and the pin connector 554B of the second frame connected to the pocket connector 558 of the bulkhead member 556. The tunnels 540A and 560A of the first frame 512A provide fluid communication from the second detonator housing 302 of the initiator module 504 to the longitudinal passage 555A of the first frame 512A, which in turn fluidly communicates with the tunnels 540B and 560B of the second frame 512B. The continuous fluid pathway from the detonator 122 in the initiator module 504 to the capsules 130A and 130B of the frames 512A and 512B activates the shaped charges in the frames 512A and 512B upon activation of the detonator 122. The electrical and fluid continuity integral to the frames 512A and 512B, along with the rotatable nature of the pin pocket connectors, provide the capability to rotate the frames 512A and 512B to any angle, which may be the same or different for the two frames 512A and 512B, while maintaining electrical and ballistic continuity.

Figure 7B:
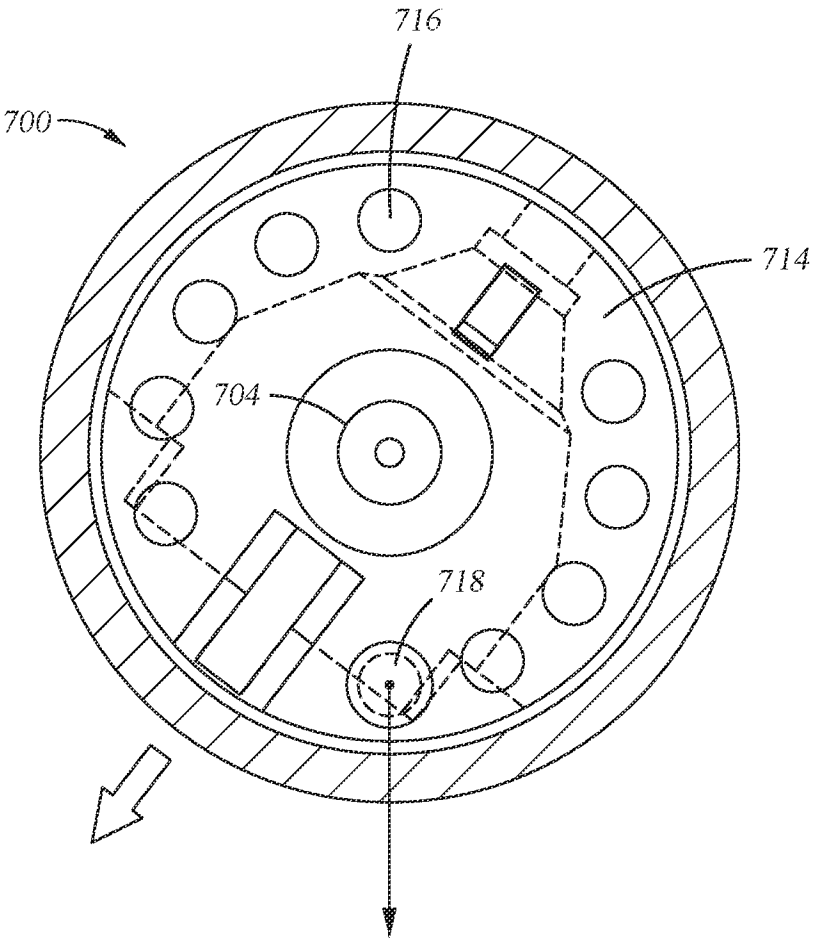
FIGS. 7A and 7B show two different uses of a shaped charge frame according to another embodiment.
Figure 7A:
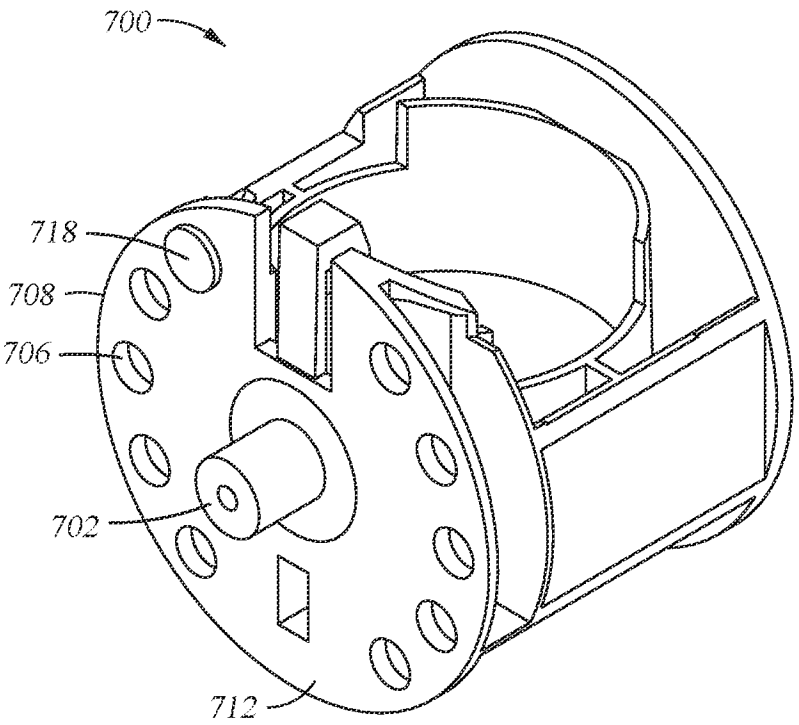

FIGS. 7A and 7B show two different uses of a shaped charge frame 700 according to another embodiment. FIG. 7A shows the shaped charge frame 700 from a first end 712 thereof and FIG. 7B shows the shaped charge frame 700 from a second end 714 thereof. The shaped charge frame 700 is similar to the shaped charge frame 512 of FIG. 5, with a first rotatable electrical connector 702 at the first end 712 and a second rotatable electrical connector 704, which is connectable with the first rotatable electrical connector 702, at the second end 714. The rotatable electrical connectors 702 and 704 may be any type of rotatable connector, of which the pin-pocket connectors of FIGS. 5 and 6 are examples. The rotatable electrical connectors 702 and 704 provide free rotation of the frame 700 when installed in a downhole tool.

The frame 700 has a plurality of openings 706 formed in the first end 712 thereof. The first end 712 has a substantially solid first disk 708, at the center of which the first rotatable connector 702 is located. The openings 706 are formed in a peripheral area of the first disk 708. The second end 714 also has a substantially solid second disk 710, at the center of which the second rotatable connector 704 is located. The second disk 710 also has a plurality of openings 716. The openings 706 and 716 may be used as alignment features when two of the frames 700 are disposed in a downhole tool. Because the frame 700 can freely rotate while maintaining electrical and fluid continuity, one frame 700 can be installed in a downhole tool with a first angular orientation and a second frame 700 can be installed in the same downhole tool with a second angular orientation different from the first angular orientation. To avoid unwanted rotation of the frames 700, a pin can be installed that extends from one of the openings 716 of a first frame 700 of the downhole tool to one of the openings 706 of a second frame 700 of the downhole tool to maintain angular orientation of the frames 700. A similar opening can be provided at an end of the initiator module 504, if desired, to lock rotation of the frames 700 with respect to the initiator module 504.

The openings 706 and 716 can also be used to provide self-orienting for the frame 700. A weight 718 can be installed in one of the openings 706 or the openings 716. Where the frame 700 is in a substantially non-vertical orientation, the weight 718 can provide imbalance in the mass distribution of the frame 700 that results in gravitational self-orientation of the frame 700. The weight 718 causes the frame 700 to rotate about the rotatable connectors 702 and 704 such that the weight 718 moves to a lowest position, orienting the frame 700 with shaped charged therein at a desired angular orientation to provide discharge in a desired direction. As shown in FIG. 7, the plurality of openings 706 and 716 can be used to provide self-orientation of the frame 700 in many directions.

Figure 8B:
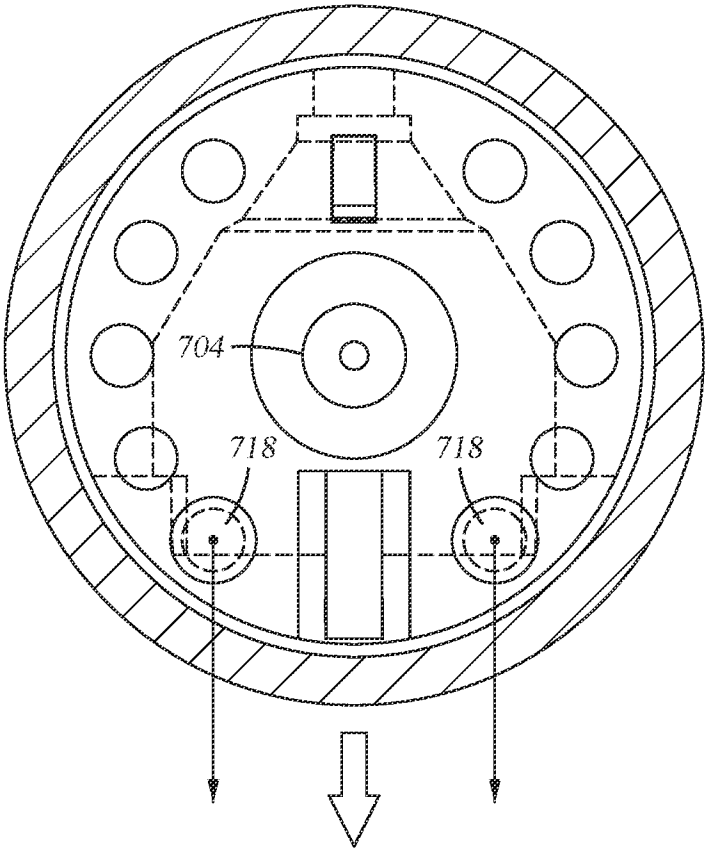
FIGS. 8A and 8B illustrate how weights can be used in the frame of FIGS. 7A and 7B to provide fractionally indexed angular self-orientation of the frame.
Figure 8A:
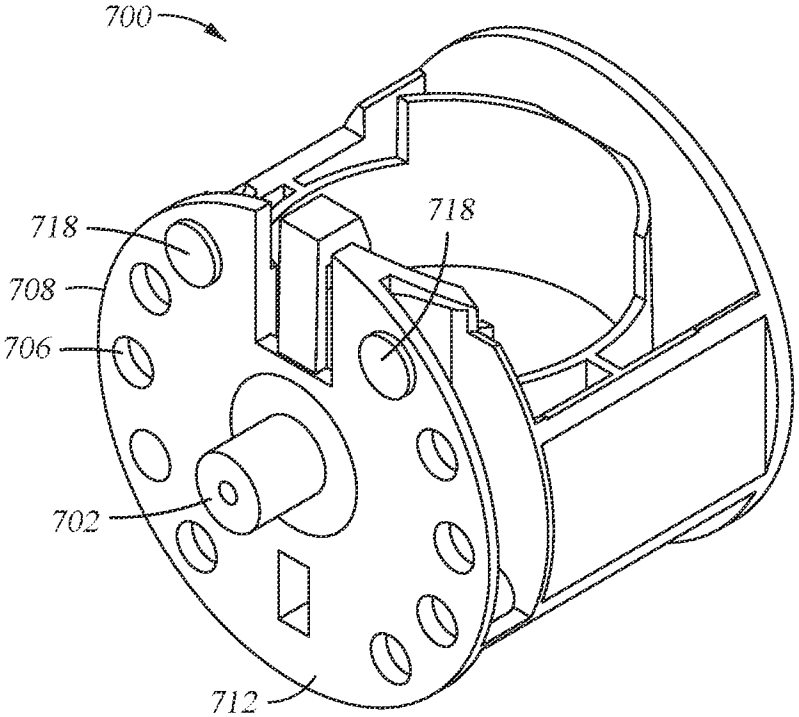

FIGS. 8A and 8B illustrate how weights 718 can be used in the frames 700 to provide fractionally indexed angular self-orientation of the frames 700. Here, two weights 718 are used to provide a fractional angular orientation that is between the angular orientations provided by use of single weights 718. Here, two weights provide a distributed mass imbalance that moves to a lowest gravitational energy position. With 10 openings 706 and 716 at either end of the frame 700, up to 20 weights 718 can be inserted into the openings to provide a very large number of unique orientations for the frames 700 to assume in a non-axial gravitational field. Of course, any number of openings can be provided in the frame 700. For example, the frame 700 might have just one opening, or just two openings, or any integer number of openings. The openings can be sized to provide space for the desired number of openings. The weights 718 are made of a dense material such as a dense metal that can substantially alter the mass distribution of the frame 700.

Figure 9:
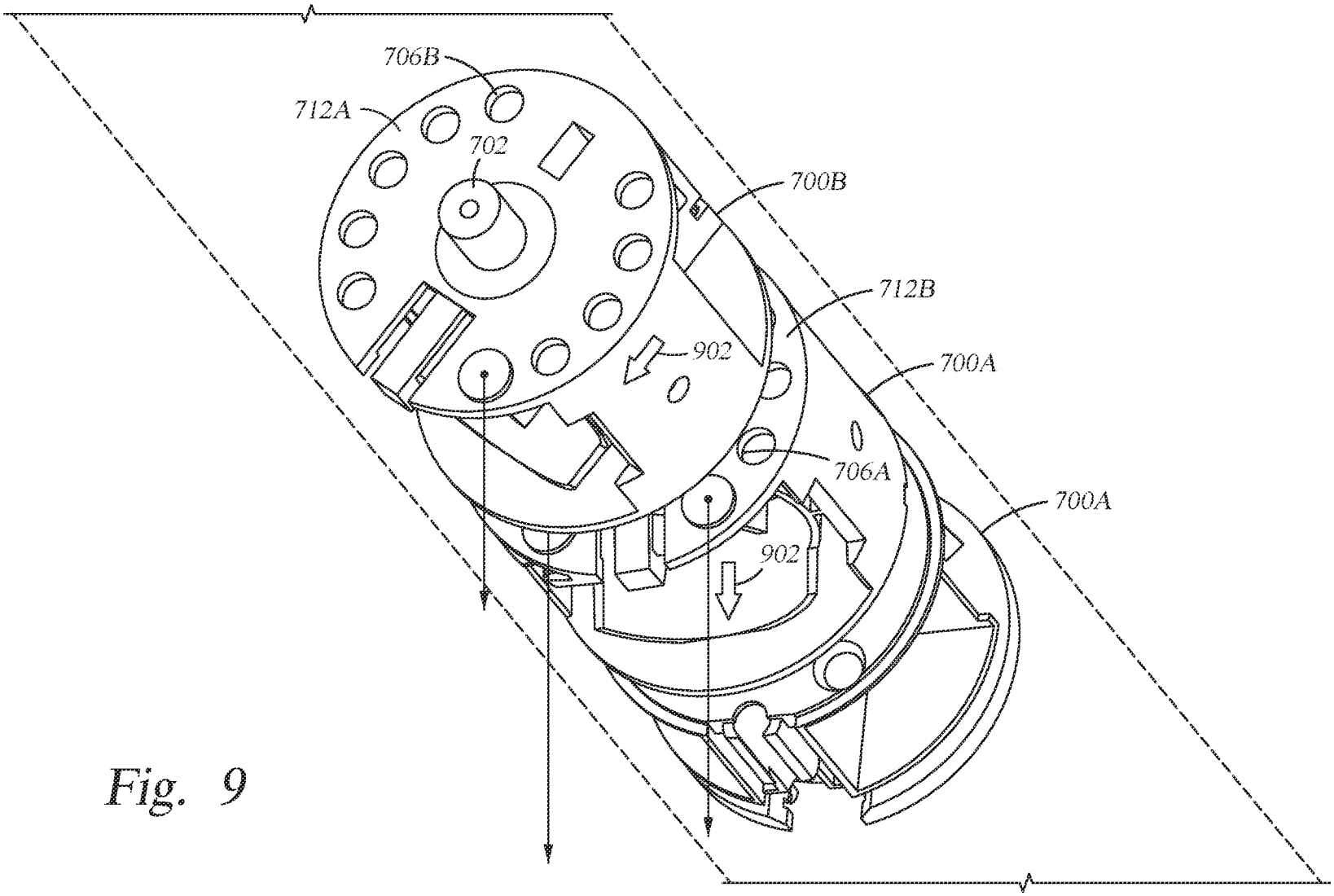
FIG. 9 illustrates the use of the self-orienting frames of FIGS. 8A and 8B in a downhole tool in the presence of a non-axial gravitational field.

FIG. 9 illustrates the use of the self-orienting frames 700 in a downhole tool in the presence of a non-axial gravitational field. Here a first frame 700A has a first weight 718A in one of the openings 706A in the first end 712A of the first frame 700A, and a second frame 700B has a second weight 7186 in one of the openings 706B in the first end 712B of the second frame 700B. The two weights 718A and 718B are disposed in different openings such that the two frames 700A and 700B have different mass distributions. Upon encountering a non-axial gravitational field, the two frames 700A and 700B rotate to lowest gravitational energy positions, with the weights 718A and 718B at lowest positions. This results in the frames self-orienting to different angular orientations, as shown by arrows 902. Here, two frames 700 are shown, but any number of frames can be used in one energy module of a downhole tool to provide directional discharges in selected directions using self-orienting shaped charge frames.

Figure 10A:
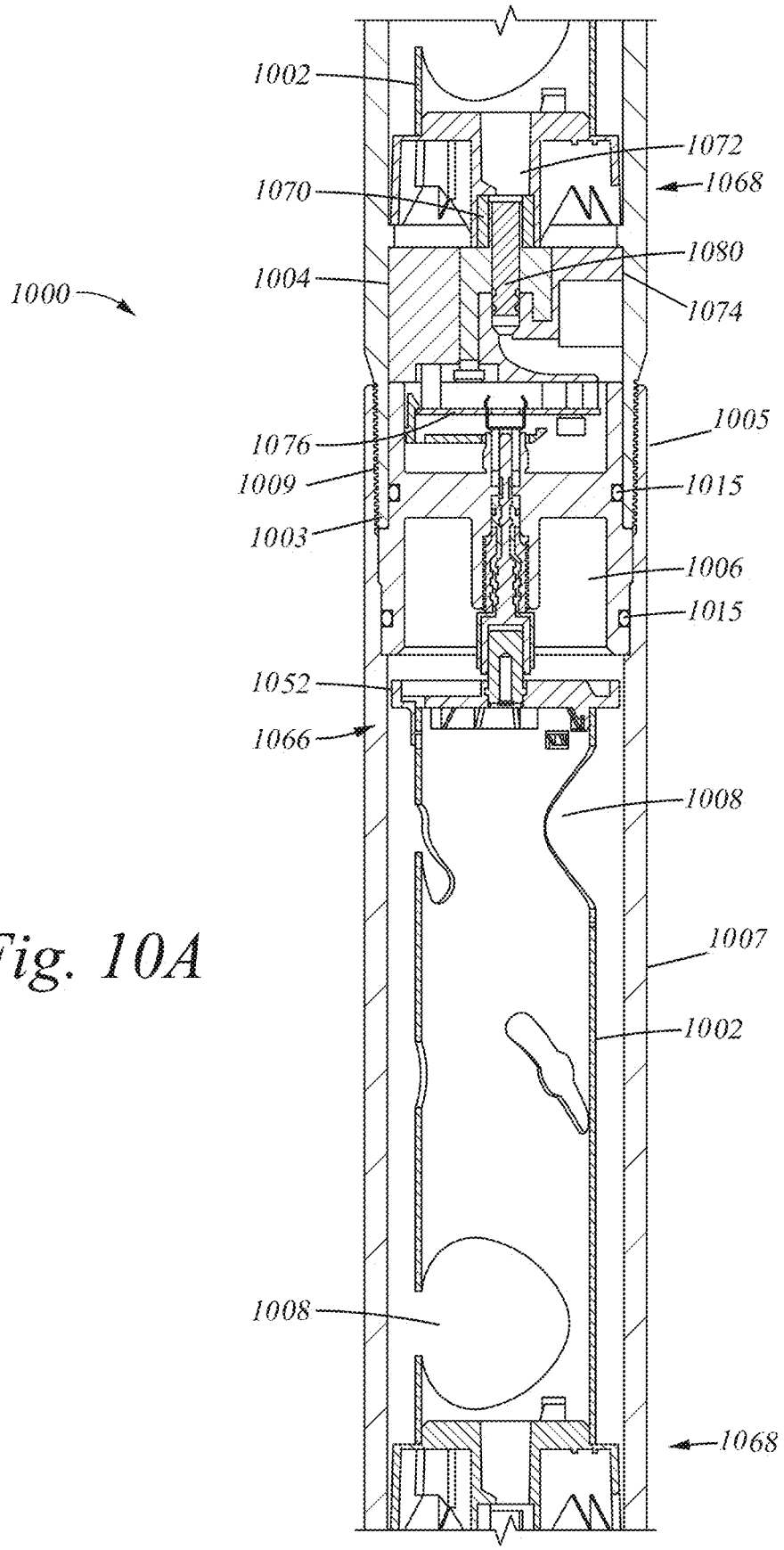
FIG. 10A is a cross-sectional view of a perforation apparatus according to one embodiment.

FIG. 10A is a cross-sectional view of a perforation apparatus 1000 according to one embodiment. The perforation apparatus 1000 has a loading tube 1002 for holding explosive charges, an initiator module 1004 that initiates discharge of the explosive charges, and a bulkhead member 1006 that separates the explosive charges of the loading tube 1002 from sensitive electronics in the initiator module 1004. The loading tube 1002 has a plurality of recesses 1008 for receiving explosive charges and orienting the charges in a phased orientation. Thus, in this case, the perforation apparatus 1000 activates a plurality of shaped charges using one initiator module 1004 and one bulkhead member 1006. Here, the recesses 1008 are arranged in a spiral arrangement pointing in various directions from the central axis of the perforation apparatus 1000 to provide phased discharge. In this case, each recess 1008 points in a different direction than the other recesses 1008, but some of the recesses 1008 could point in the same direction. Here, each recess 1008 points in a direction, and the direction of each recess 1008 forms a constant angle with the direction of neighboring recesses 1008. That is to say, in this case, the direction of each recess i and the direction of the neighboring recess i+1 forms an angle that is constant for all recesses i.

Figure 10B:
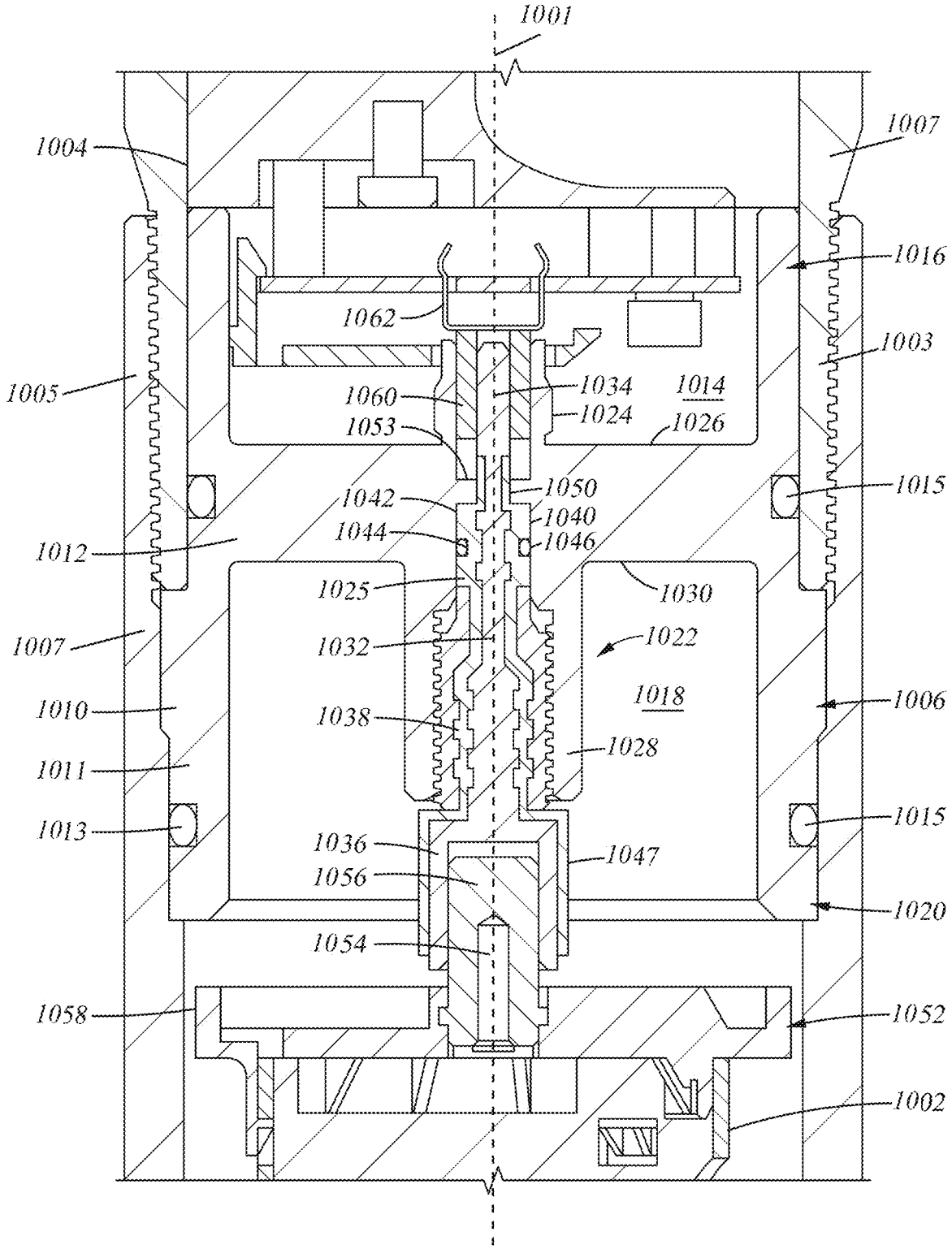
FIG. 10B is a detail view of the bulkhead member of FIG. 10A.

FIG. 10B is a detail view of the bulkhead member 1006 of FIG. 10A. The bulkhead member 1006 has a generally cylindrical body 1010, or a shape conducive to housing in a desired casing. The body 1010 of the bulkhead member 1006 may be solid, or may be mostly hollow, as in this case. Here, the body 1010 has an outer shell 1011 with a central plate 1012 transverse to a longitudinal axis of the body 1010. The outer surface of the outer shell 1011 has conveniently placed grooves 1013 to receive seal members 1015 for sealing against an outer casing. The central plate 1012 provides structural support for components of the bulkhead member 1006, while the hollow configuration of the body 1010 reduces weight. The central plate 1012 defines a first cavity 1014, generally facing a first end 1016 of the body 1010, and a second cavity 1018, generally facing a second end 1020 of the body 1010. The central plate 1012 separates the first cavity 1014 from the second cavity 1018 such that when the bulkhead member 1006 is assembled into a perforating tool, the first cavity 1014 faces a first tool member and the second cavity 1018 faces a second tool member. In the case of FIG. 10A, the first cavity 1014 faces the initiator module 1004 and the second cavity 1018 faces the loading tube 1002.

The central plate 1012 supports a feedthrough 1022, which provides a conduit for electrical conductivity from the first end 1016 to the second end 1020 of the bulkhead member 1006. The feedthrough 1022 has a central bore 1025, oriented along the longitudinal axis of the bulkhead member 1006, that extends through the central plate 1012 from the first cavity 1014 to the second cavity 1018. A first protrusion 1024 extends from a first side 1026 of the central plate 1012 into the first cavity 1014, and a second protrusion 1028 extends from a second side 1030 of the central plate 1012 into the second cavity 1018. The central bore 1025 extends along and within the first protrusion 1024, through the central plate 1012, and along and within the second protrusion 1028 to provide a pathway through the central plate 1012 from the first cavity 1014 to the second cavity 1018.

The bulkhead member 1006, here, is non-symmetric. The bulkhead member 1006 has a generally cylindrical shape with a central longitudinal axis 1001 that generally resembles a cylindrical axis. In one aspect, a center of mass of the bulkhead member 1006 is closer to the first end 1016 of the bulkhead member 1006 than to the second end 1020 of the bulkhead member 1006. In another aspect, the bulkhead member 1006 has no plane of symmetry that intersects the central longitudinal axis 1001. For example, the bulkhead member 1006 has no transverse plane of symmetry.

An electrical conductor 1032 is disposed in the central bore 1025 to provide electrical conductivity from the first end 1016 to the second end 1020 of the bulkhead member 1006. The electrical conductor 1032 has a pin connection 1034 at a first end thereof and a box connection 1036 at a second end thereof opposite from the first end. When the electrical conductor 1032 is installed in the bulkhead member 1006, the pin connection 1034 is disposed in the first protrusion 1024 and the box connection 1036 extends beyond the second protrusion 1028. The electrical conductor 1032 is a rod-like member that extends from the pin connection 1034 at the first end to the box connection 1036 at the other end The box connection 1036 is a hollow cylindrical member with diameter larger than a diameter of the rest of the electrical conductor 1032 so that the box connection 1036 can receive an electrical connector of another tool into the hollow cylindrical box connection 1036. In some embodiments, the box connection 1036 may be described as a "female" electrical connection, while the pin connection 1034 may be described as a "male" electrical connection. Here, the pin connection 1034 is axially rigid with no axial movement capability such as spring-loading or extension/retraction.

An electrical insulator 1038 is disposed within the central bore 1025 around the electrical conductor 1032 to prevent electrical connection between the electrical conductor 1032 and the body 1010. The body 1010 is typically made of steel to provide pressure insulation between the loading tube 1002, where the charges discharge, and the initiator module 1004, where sensitive electronics are located to control operation of the tool. In some embodiments, where the body 1010 can be made from a dense, hard, non-conducive material, such as hard plastic, the electrical insulator 1038 might not be needed. The electrical insulator 1038 has a seal portion 1040 that inserts into a throat 1042 of the central bore that extends into the central plate 1025. The seal portion 1040 has a groove 1044 that accommodates a seal member 1046 to provide a secure fit for the electrical conductor 1032 within the central bore 1025. The electrical insulator 1038 extends from the seal portion 1040 to an entry portion 1047 that houses the box connection 1036 of the electrical conductor 1032. The entry portion 1047 has a shape similar to the shape of the box connection 1036, in this case a hollow cylindrical shape with an inner diameter approximately equal to an outer diameter of the box connection 1036 so that an inner surface of the electrical insulator 1038 contacts an outer surface of the box connection 1036. The seal members 1015 and 1046 provide pressure seal against the hydrostatic pressure of the well environment, as well as pressure seal between adjacent tools.

The electrical conductor 1032 extends beyond the seal portion 1040 of the electrical insulator 1038 through the central plate 1012, where the central bore 1025 defines an annular gap 1050 around the electrical conductor 1038. A wall 1053 extends radially inward from an interior wall of the central bore 1025 toward the electrical conductor 1032 to define the gap 1050. The electrical conductor 1032 further extends into the first protrusion 1024 to the pin connection 1034. The electrical insulator 1038 thus extends from the box connection 1038 partway along the length of the electrical conductor 1032 to the annular gap 1050. Each of the electrical insulator 1038 and the electrical conductor 1032 extends beyond the second protrusion into the second cavity 1018 and beyond the second end of the body 1010 to provide an accessible electrical connection to accommodate another tool.

In FIG. 10B, the loading tube 1002 has a connector 1052 that can be inserted into the box connection 1038 of the bulkhead member 1006. The connector 1052 has a metal pin 1054 and a metal stub 1056 over the metal pin 1054, with an overmolded plastic body 1058 that locates the metal pin 1054 and metal stub 1056 at the end of the loading tube 1002. Inserting the metal stub 1056 into the box connection 1038 of the bulkhead member 1006 establishes electrical connection between the bulkhead member 1006 and the loading tube 1002.

A plug connector 1060 is disposed within the end of the first protrusion 1024 around the pin connection 1036 of the electrical conductor 1032. The plug connector 1060 provides electrical connection to a wire contact 1062 of the initiator module 1004. The plug connector 1060 can be an RCA connector, or another convenient type of connector. The wire contact 1062 connecting with the plug connector 1060 electrically connects the bulkhead member 1006 with the initiator module 1004. In this way, electrical connection is established from the initiator module 1004, through the bulkhead member 1006, to the loading tube 1002.

Returning to FIG. 10A, electrical conductivity is established along the loading tube 1002 by connecting a wire (not shown) to the connector 1052. The connector 1052 is a first connector of the loading tube 1002, located at a first end 1066 thereof. The loading tube 1002 has a second connector 1064 located at a second end 1068 thereof, opposite from the first end. The wire is connected from the first connector 1052 to the second connector 1064, traversing the length of the loading tube 1002 according to any convenient path.

A second loading tube 1002 is shown in FIG. 10A to illustrate connection of the loading tube 1002, at the second end 1068 thereof, to the initiator module 1004. A band connector 1070 is disposed in a central recess 1072 of the second connector 1064. The band connector 1070 makes electrical contact with a housing 1074 of the initiator module 1004. The housing provides electrical connection to the wire contact 1062 (FIG. 10B) of the initiator module 1004 and a circuit board 1076 disposed at an end of the initiator module 1004 that connects to the bulkhead member 1006, and oriented generally transverse to the longitudinal axis of the perforation tool 1000. Alternately, in embodiments where the housing 1074 is made of a non-conductive material, an electrical contact can be provided for connecting with the band connector 1070, and an electrical conductor can be routed through the housing 1074 for connection with the wire contact 1062 and the circuit board 1076.

The loading tube 1002, initiator module 1004, and bulkhead member 1006 all fit within a housing 1007. In FIG. 10A, the housings 1007 of two adjacent and connected perforation assemblies are shown connected by a threaded connection 1009, each end of each housing 1007 having threads. Each housing 1007 has a first end 1003 and a second end 1005, opposite from the first end 1003, with each end 1003 and 1005 having threads. Here, the bulkhead member 1006 is shown connecting with each end 1003 and 1005 of a housing 1007. Referring again to FIG. 10B, the first end 1016 of the bulkhead member 1006 engages with a first end 1003 of a first housing 1007 while the second end 1020 of the bulkhead member 1006 engages with a second end 1005 of a second housing 1007, which is coupled to the first housing 1007. In this case, the bulkhead member 1006 connects with each housing using a friction fit, with a non-threaded connection, but a threaded connection can be used to connect the bulkhead member 1006 with either the first end 1003 or the second end 1005 of a housing 1007.

In operation a detonator 1080 (FIG. 10A) is disposed in a recess of the initiator module 1004. The detonator 1080 extends into the central recess 1072 of the second connector 1064 of the loading tube 1002. A booster (not shown) is also disposed in the central recess 1072 of the second connector 1064. Detonation cord is connected to the booster and routed along the loading tube 1002 to the charges held therein. An electrical signal received at the circuit board 1076, causes the circuit board to send an electrical signal that activates the detonator 1080, which in turn discharges the booster. The ballistic discharge of the booster is transmitted by the detonation cord to the charges held in the loading tube 1002.

Figure 11A:
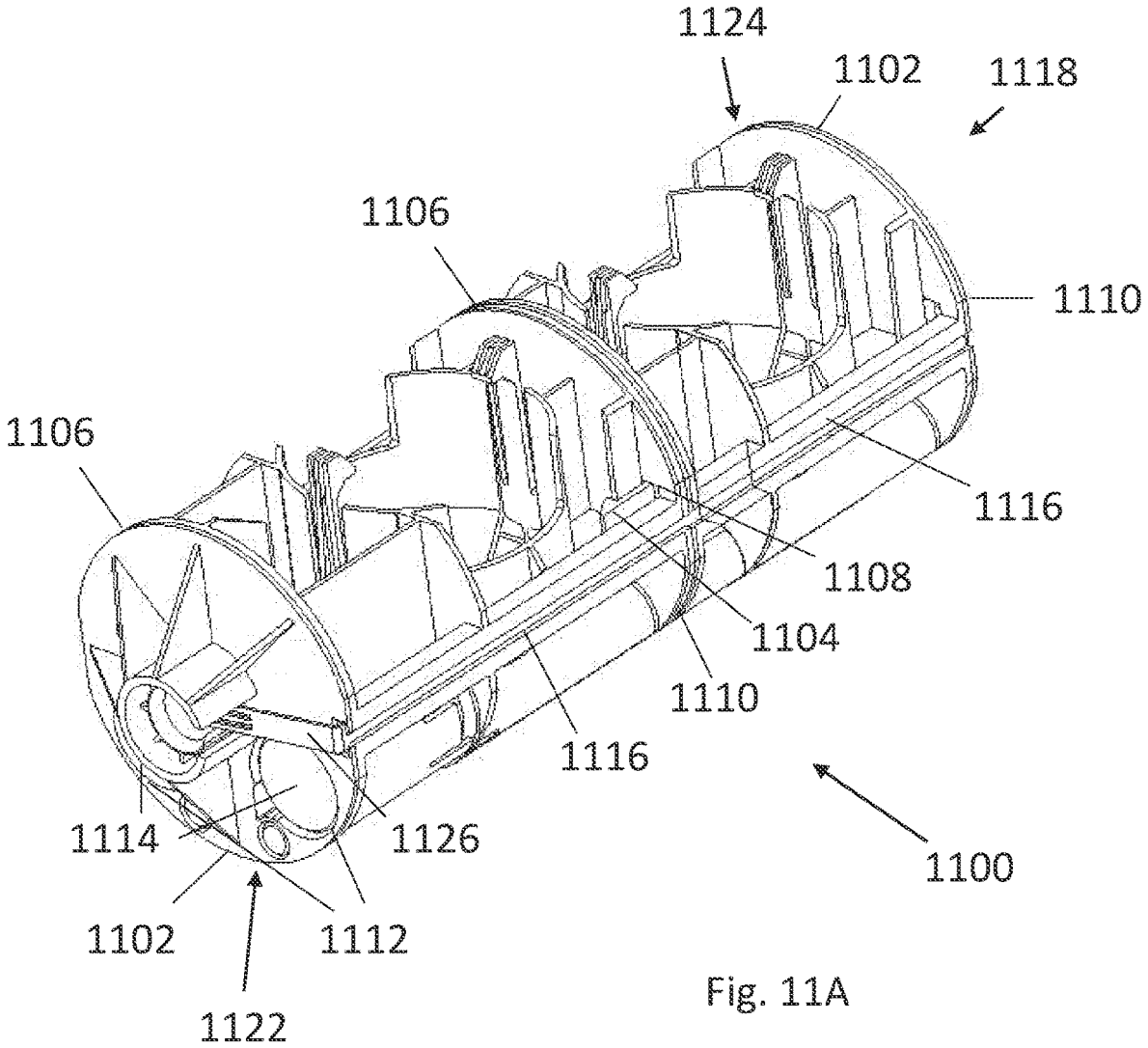
FIG. 11A is a perspective side view of an energy module according to another embodiment.

FIG. 11A is a perspective side view of an energy module 1100 according to another embodiment. The energy module 1100 is a modular assembly, with a plurality of shaped charge frames 1102 that connect together. Here, each shaped charge frame 1102 holds one shaped charge, similar to the shaped charge frames 102 of FIG. 2. Each shaped charge frame 1102 has at least two prongs 1104 at a first end 1106 of the frame 1102, and a matching number of openings 1108 at a second end 1110 of the frame 1102 to receive the prongs 1104 of another frame 1102. In this way, multiple frames 1102 can be connected together to form a shaped charge frame assembly 1100. Like the posts 208 of FIG. 2, the prongs 1104 and openings 1108 align the frames 1102 and maintain alignment of the frames 1102. The frames 1102 are rotatable using the rotation methods and apparatus described herein.

Figure 11B:
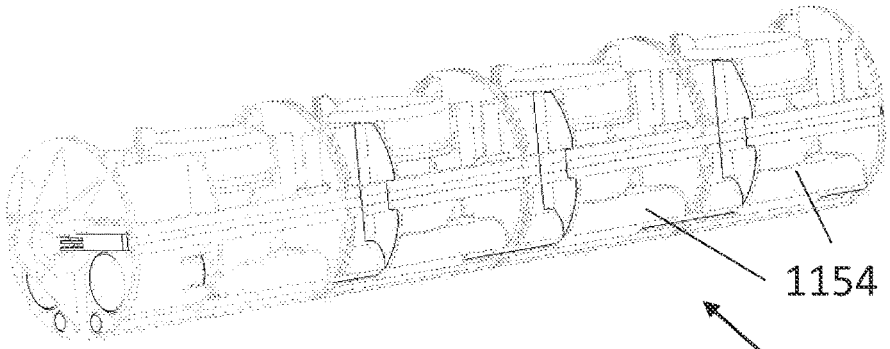
FIG. 11B is a perspective side view of a modular shaped charge frame.

It should be noted that the shaped charge frames 1102 could hold more than one shaped charge. FIG. 11B is a perspective side view of a modular shaped charge frame 1152, like the shaped charge frame 1102, that holds four shaped charges. Here, four of the frames 1102 are yoked together to form the modular frame 1152. The frame 1152 uses detonation cord for ballistic continuity from the initiator module to the four shaped charges, and can use the various electrical continuity methods described elsewhere herein. Each of the frames 1102 has a peripheral conduit 1154 that runs adjacent to the narrow end of each shaped charge receptacle in each frame 1102. The conduits 1154 form a continuous passage along the periphery of the modular frame 1152 to accommodate the detonation cord, or other ballistic transfer mechanism. The frame 1152 can also engage or connect with the initiator modules and bulkhead members described herein, can rotate using the rotation methods and apparatus described herein, and can self-orient using weight members to adjust center of gravity, as described herein.

At least one of the shaped charge frames 1102 has openings 1112 at the first end 1106, the second end 1108, or both to receive weight members 1114 to make the energy module 1100 self-orienting, as described elsewhere herein. Ballistic continuity is accomplished in the shaped charge frames 1102 using methods and apparatus described herein. Each of the frames 1102 has an external conduit 1116 that extends along an external radius 1118 of the frame 1102 in an axial direction thereof. The external conduits 1116 of connected frames 1102 form a single external conduit 1120 along the external radius 1118 of the frames 1102 from a first end 1122 of the energy module 1100 to a second end 1124 of the energy module 1100, opposite from the first end.

An electrical conductor 1126, similar to the electrical conductor 132 of FIG. 1C, can be disposed through the external conduit 1120 from the first end 1122 to the second end 1124. The electrical conductor 1126, so disposed, provides electrical continuity from the first end 1122 to the second end 1124 of the energy module 1100. Any number of the frames 1102 can be thus chained together to house shaped charges in an energy module between an initiator module and a bulkhead member according to the manner of FIG. 11A.

While the foregoing is directed to embodiments of the present invention, other and further embodiments of the present disclosure may be devised without departing from the basic scope thereof, and the scope thereof is determined by the claims that follow.

What is claimed is:

1. A perforation tool, comprising:

a container with a longitudinal axis;

an initiator module in the container, the initiator module having a firing circuit, an electrical contact at the longitudinal axis, and a detonator housing;

a shaped charge frame in the container, the shaped charge frame having:

a first end;

a second end opposite the first end;

a recess for accepting a shaped charge between the first end and the second end, the recess having a wide end and a narrow end, wherein the longitudinal axis is between the wide end and the narrow end;

a first electrical contact at the first end, the first electrical contact located at the longitudinal axis;

a second electrical contact at the second end, the second electrical contact located at the longitudinal axis;

an electrical conductor connecting the first and second contacts, the electrical conductor detachably disposed in a longitudinal passage at a periphery of the shaped charge frame;

a ballistic pathway coupling the detonator housing to the narrow end of the recess; and an opening to receive a weight; and a non-symmetric bulkhead member, the shaped charge frame being between the non-symmetric bulkhead member and the initiator module.

2. The perforation tool of claim 1, wherein the detonator housing is located along the longitudinal axis.

3. The perforation tool of claim 1, wherein the ballistic pathway comprises a detonation cord.

4. The perforation tool of claim 1, wherein each of the first and second electrical contacts is a flat spring contact.

5. A frame for a shaped charge, the frame comprising:

a body having a central longitudinal axis, a first end, a second end opposite the first end;

a receptacle for a shaped charge, the receptacle having a wide end and a narrow end, wherein the central longitudinal axis is between the wide end and the narrow end;

an electrical conductor disposed in a passage through a periphery of the frame from the first end to the second end of the frame, wherein the electrical conductor is a flat bar shape, and has a first end located adjacent to a central area of the first end of the frame and a second end located adjacent to a central area of the second end of the frame; and a ballistic pathway disposed in the frame adjacent to the narrow end of the receptacle and fluidly coupled to an opening in the first end of the frame.

6. The frame of claim 5, wherein the ballistic pathway is also fluidly coupled to an opening in the second end of the frame.

7. The frame of claim 6, wherein the opening in the first end of the frame is at the central longitudinal axis and the opening at the second end of the frame is at the central longitudinal axis.

8. The frame of claim 7, further comprising a first tunnel fluidly coupling the capsule housing to the first opening and a second tunnel fluidly coupling the capsule housing to the second opening.

9. The frame of claim 5, wherein each of the first end and the second end of the electrical conductor is resilient.

10. The frame of claim 9, wherein each of the first end and the second end of the electrical conductor is a flat spring.

* * * * *